US009358796B2

(12) United States Patent
Tsukahara et al.

(10) Patent No.: US 9,358,796 B2
(45) Date of Patent: Jun. 7, 2016

(54) LIQUID SUPPLY APPARATUS

(71) Applicant: SEIKO EPSON CORPORATION, Tokyo (JP)

(72) Inventors: Katsutomo Tsukahara, Nagano (JP); Eiko Yanagida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/723,781

(22) Filed: May 28, 2015

(65) Prior Publication Data

US 2015/0343786 A1 Dec. 3, 2015

(30) Foreign Application Priority Data

May 29, 2014 (JP) ..... 2014-111247

(51) Int. Cl.

*B41J 2/175* (2006.01)
*B41J 2/14* (2006.01)
*B41J 29/13* (2006.01)

(52) U.S. Cl.

CPC ..... *B41J 2/1752* (2013.01); *B41J 2/17526* (2013.01)

(58) Field of Classification Search

CPC .... B41J 2/175; B41J 2/17509; B41J 2/17546; B41J 2/17559; B41J 3/543; B41J 29/02; B41J 29/13
USPC ..... 347/7, 49, 50, 85, 108
See application file for complete search history.

(56) References Cited

U.S. PATENT DOCUMENTS 5,852,459 A * 12/1998 Pawlowski, Jr. ..... B41J 2/175 347/6
6,276,789 B1 * 8/2001 Miyazaki ..... B41J 2/17503 347/86
7,008,050 B2 * 3/2006 Childers ..... B41J 2/17506 347/85
7,008,051 B2 * 3/2006 Akermalm ..... B41J 2/17509 347/85
7,753,500 B2 * 7/2010 Nishida ..... B41J 2/17509 347/104
8,087,764 B2 * 1/2012 Niimi ..... B41J 2/2114 347/85
2014/0253645 A1 9/2014 Tsukahara et al.
2014/0360596 A1 12/2014 Tsukahara et al.

FOREIGN PATENT DOCUMENTS

JP 2014-172263 A 9/2014
JP 2014-237223 A 12/2014
WO 97/42035 A1 11/1997

* cited by examiner

*Primary Examiner* — Anh T. N. Vo
(74) *Attorney, Agent, or Firm* — Global IP Counselors, LLP

(57) ABSTRACT

A liquid supply apparatus includes: a plurality of liquid containers, each including a liquid container part that is capable of storing a liquid, and a liquid supply part that is in communication with the inside of the liquid container part and is capable of supplying the liquid in the liquid container part to a recording head of a liquid ejection recording apparatus; and a casing that detachably houses therein the plurality of liquid containers and that is supported by the liquid ejection recording apparatus. At least two of the plurality of liquid containers are arranged along a top-to-bottom direction within the casing.

16 Claims, 21 Drawing Sheets

FIRST STATE

SECOND STATE

PARTIAL CROSS-SECTIONAL VIEW ALONG F9A-F9A

PARTIAL CROSS-SECTIONAL
VIEW ALONG F9B-F9B

VIEW IN THE DIRECTION OF ARROW F14

LIQUID SUPPLY APPARATUS

BACKGROUND

1. Technical Field

The present invention relates to a technology for supplying a liquid to a liquid ejection recording apparatus.

2. Related Art

An ink supply apparatus having one ink bag on a side of a printer housing is known (e.g., WO 97/42035). According to the technology disclosed in WO 97/42035, the ink in the ink bag is supplied to a cartridge attached to the inside of the printer, via a supply tube.

Here, in some cases, the demand for increasing the types (e.g., colors) of the ink used in the printer, or the demand for increasing the number of the ink bags might arise. Related arts disclose neither a configuration nor a layout of an ink supply apparatus that takes such demands into account. In addition, according to related arts, a dead space occurs below the ink bag in some cases.

Such problems are not specific to the technology for supplying ink to a printer, but are common to technologies for supplying a liquid to a liquid ejection recording apparatus that ejects a liquid to a medium.

SUMMARY

The invention is made to solve at least some of the above-described problems, and aims to provide a technology for effectively using space so that a plurality of liquid containers can be arranged. In the related arts, there also are the demands for cost reduction, resource saving, manufacture simplification, improvement in usability, the technology for simplifying the configuration, and so on.

The invention is made to solve at least some of the above-described problems, and may be implemented in the following modes:

(1) According to one mode of the invention, a liquid supply apparatus that is capable of supplying a liquid to a recording head of a liquid ejection recording apparatus is provided. This liquid supply apparatus includes: a plurality of liquid containers, each including a liquid container part that is capable of storing the liquid, and a liquid supply part that is in communication with the inside of the liquid container part and that is capable of supplying the liquid in the liquid container part to the liquid ejection recording apparatus; and a casing that detachably houses therein the plurality of liquid containers and that is supported by the liquid ejection recording apparatus. At least two of the plurality of liquid containers are arranged along a top-to-bottom direction within the casing.

According to the liquid supply apparatus having this configuration, the plurality of liquid containers are arranged along the top-to-bottom direction. Therefore, it is possible to provide a liquid supply apparatus in which a plurality of liquid containers are arranged while suppressing the increase in size in the horizontal direction (direction that is perpendicular to the top-to-bottom direction).

(2) In the liquid supply apparatus in the above-described mode, among the at least two of the plurality of liquid containers arranged in the top-to-bottom direction, liquid containers that are adjacent in the top-to-bottom direction may be each offset in a direction that intersects with the top-to-bottom direction.

According to the liquid supply apparatus in this mode, the liquid containers arranged along the top-to-bottom direction are offset in the intersecting direction. Therefore, the operation for attaching/detaching the liquid containers to/from the casing is easy.

(3) In the liquid supply apparatus in the above-described mode, the plurality of liquid containers may include a first-type liquid container that stores a first amount of the liquid and a plurality of second-type liquid containers that each store a second amount of the liquid, the second amount being smaller than the first amount. The plurality of second-type liquid containers may be arranged along a direction that is parallel with a longitudinal direction of the first-type liquid container. At least part of each of the plurality of second-type liquid containers, when seen from a direction that is orthogonal to the longitudinal direction, may overlap the first-type liquid container.

According to the liquid supply apparatus in this mode, the first-type and second-type liquid containers having different capacities can be arranged, effectively using the space within the casing.

(4) In the liquid supply apparatus in the above-described mode, a front face of the liquid ejection recording apparatus may be provided with a recording medium outlet for discharging a recording medium. The casing may be located on at least one of right and left wall surfaces of the liquid ejection recording apparatus when the liquid ejection recording apparatus is seen from the front face.

According to the liquid supply apparatus in this mode, the casing is located on at least one of the left and right wall surfaces when seen from the front face. Therefore, this configuration improves the operability when operated from the side of the front face.

(5) In the liquid supply apparatus in the above-described mode, the plurality of liquid containers may include a first-type liquid container that stores a first amount of the liquid and a second-type liquid container that stores a second amount of the liquid, the second amount being smaller than the first amount. The first-type liquid container may be located closer to the front face than the second-type liquid container is.

According to the liquid supply apparatus in this mode, the operation for attaching/detaching the first-type liquid container from the side of the front face of the casing is easy.

(6) The liquid supply apparatus in the above-described mode may include a liquid introduction part that is connected to the liquid supply part and that distributes the liquid introduced from the liquid supply part to the liquid ejection recording apparatus. The liquid introduction part may be provided in a plurality within the casing, in correspondence with the plurality of liquid containers. The plurality of liquid introduction parts may be arranged so as to correspond in arrangement position to the plurality of liquid containers.

According to the liquid supply apparatus in this mode, the liquid containers can be attached to the inside of the casing with reference to the arrangement positions of the liquid introduction parts.

(7) In the liquid supply apparatus in the above-described mode, each of the plurality of liquid containers may further include a container-side electrical connection part. The liquid supply apparatus may further include an apparatus-side electrical connection part that is capable of establishing electrical connection by contacting with the container-side electrical connection part. The apparatus-side electrical connection part may be provided in a plurality within the casing, in correspondence with the plurality of liquid containers. The plurality of apparatus-side electrical connection parts may be arranged so as to correspond in arrangement position to the plurality of liquid containers.

According to the liquid supply apparatus in this mode, the liquid containers can be attached to the inside of the casing with reference to the arrangement positions of the apparatus-side electrical connection parts.

(8) In the liquid supply apparatus in the above-described mode, each of the plurality of liquid containers may be provided within the casing such that the container-side electrical connection part is located above a level of the liquid container part.

According to the liquid supply apparatus in this mode, the container-side electrical connection part is located above the level of the liquid container parts. Therefore, the visibility of the container-side electrical connection part is improved at the time of attaching the liquid containers to the inside of the casing.

(9) In the liquid supply apparatus in the above-described mode, each of the plurality of liquid containers may be provided within the casing such that the liquid supply part is located above a level of the liquid container part.

According to the liquid supply apparatus in this mode, the liquid supply parts are located above the level of the liquid container parts. Therefore, the visibility of the liquid supply parts is improved at the time of attaching the liquid containers to the inside of the casing.

(10) In the liquid supply apparatus in the above-described mode, each of the plurality of liquid containers may further include a handle part that is grippable. The handle part and the liquid supply part may be arranged on one end portion of the corresponding liquid container part.

According to the liquid supply apparatus in this mode, the handle part and the liquid supply part are arranged on the same side with respect to the liquid container part. Therefore, it is easy to change the position of the liquid supply part by gripping the handle part and moving the liquid container.

(11) In the liquid supply apparatus in the above-described mode, the casing may be provided in a plurality, and each of the plurality of casings may be supported at a different one of wall surfaces of the liquid ejection recording apparatus.

According to the liquid supply apparatus in this mode, a plurality of casing can be arranged by using the plurality of wall surfaces of the liquid ejection recording apparatus.

(12) In the liquid supply apparatus in the above-described mode, the casing may be provided in a plurality, and the plurality of casings may be supported at one of wall surfaces of the liquid ejection recording apparatus along the top-to-bottom direction.

According to the liquid supply apparatus in this mode, a plurality of casing can be arranged by using the wall surface of the liquid ejection recording apparatus.

(13) According to another mode of the invention, a liquid supply apparatus that is capable of supplying a liquid to a recording head of a liquid ejection recording apparatus is provided. This liquid supply apparatus includes: a liquid container including a liquid container part that is capable of storing the liquid, and a liquid supply part that is in communication with the inside of the liquid container part and that is capable of supplying the liquid to the recording head of the liquid ejection recording apparatus; and a plurality of casings that each detachably houses therein the liquid container and that is supported by the liquid ejection recording apparatus. The plurality of casings are arranged along a top-to-bottom direction on one of wall surfaces of the liquid ejection recording apparatus.

According to the liquid supply apparatus in this mode, a plurality of casings are arranged along the top-to-bottom direction on one wall surface. Therefore, it is possible to provide a liquid supply apparatus in which a plurality of casings are arranged while suppressing the increase in size in the direction that is perpendicular to the top-to-bottom direction.

(14) In the liquid supply apparatus in the above-described mode, at least one of the plurality of casings may be supported by a paper feed cassette device of the liquid ejection recording apparatus, the paper feed cassette device being detachably attached to a main body of the liquid ejection recording apparatus.

According to the liquid supply apparatus in this mode, another casing can be added by adding another paper feed cassette device. This configuration is readily adaptable to design changes, for example in the case of increasing the number of ink types or the number of the liquid containers.

(15) In the liquid supply apparatus in the above-described mode, each of the plurality of casings may include a liquid introduction part that is connectable to the liquid supply part, and a flow passage member that is flexible and is connected to the liquid introduction part, the flow passage member supplying the liquid from the liquid introduction part to the recording head of the liquid ejection recording apparatus.

According to the liquid supply apparatus in this mode, when designing the flow passages of the liquid from the liquid containers to the liquid ejection recording apparatus, the flexibility in designing of the distribution channels can be increased by using the flexible flow passage member. For example, the direction in which the flow passage member of each of the plurality of casing extends is adjustable.

(16) In the liquid supply apparatus in the above-described mode, each of the plurality of casings may further include a member relay part on at least one end portion thereof in the top-to-bottom direction, the member relay part guiding the flow passage member to the outside of the corresponding casing.

According to the liquid supply apparatus according in this mode, the flow passage member can be guided to the outside of the casing by using the member relay part.

(17) In the liquid supply apparatus in the above-described mode, the liquid container may further include a container-side electrical connection part, and each of the plurality of casings may further include an apparatus-side electrical connection part that is capable of establishing electrical connection by contacting with the container-side electrical connection part, and an electric wire electrically connected to the apparatus-side electrical connection part and to the liquid ejection recording apparatus.

According to the liquid supply apparatus in this mode, even when a plurality of casings are arranged along the top-to-bottom direction, the electric wires improve the flexibility in designing of the electrical channels from the liquid containers to the liquid ejection recording apparatus. For example, the directions in which the respective electric wires of the plurality of casings arranged along the top-to-bottom direction extend can be adjusted.

(18) In the liquid supply apparatus in the above-described mode, each of the plurality of casings may further include a wire relay part on at least one end portion thereof in the top-to-bottom direction, the wire relay part guiding the electric wire to the outside of the corresponding casing.

According to the liquid supply apparatus in this mode, the electric wire can be guided to the outside of the casing by using the wiring relay part.

The constituent elements included in the above-described modes of the invention are not all essential, and in order to solve some or all of the above-described problems or achieve some or all of the advantageous effects described in this specification, some of the constituent elements can be modified, omitted, and replaced with other constituent elements as necessary, and the limiting content can be partially omitted. Also, in order to solve some or all of the above-described problems or achieve some or all of the above-described advantageous effects, some or all of the technical features in any of the above-described modes of the invention can be combined with some or all of the technical features included in another one of the above-described modes of the invention so as to obtain an independent mode of the invention.

For example, one mode of the invention can be implemented as an apparatus that includes at least one element out of a plurality of elements, namely the liquid container and the casing. In other words, this apparatus may have or not have the liquid container. Also, this apparatus may have or not have the casing. According to such modes, it is possible to solve at least one of various problems such as achieving apparatus size reduction, cost reduction, resource saving, manufacture simplification, and improvement in usability. Some or all of the technical features of the above-described modes of the liquid container can be applied to this apparatus.

Note that the invention can be implemented in various modes, and can be implemented in various aspects such as a liquid supply apparatus manufacturing method, and a liquid injection recording system including a liquid supply apparatus and a liquid ejection recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
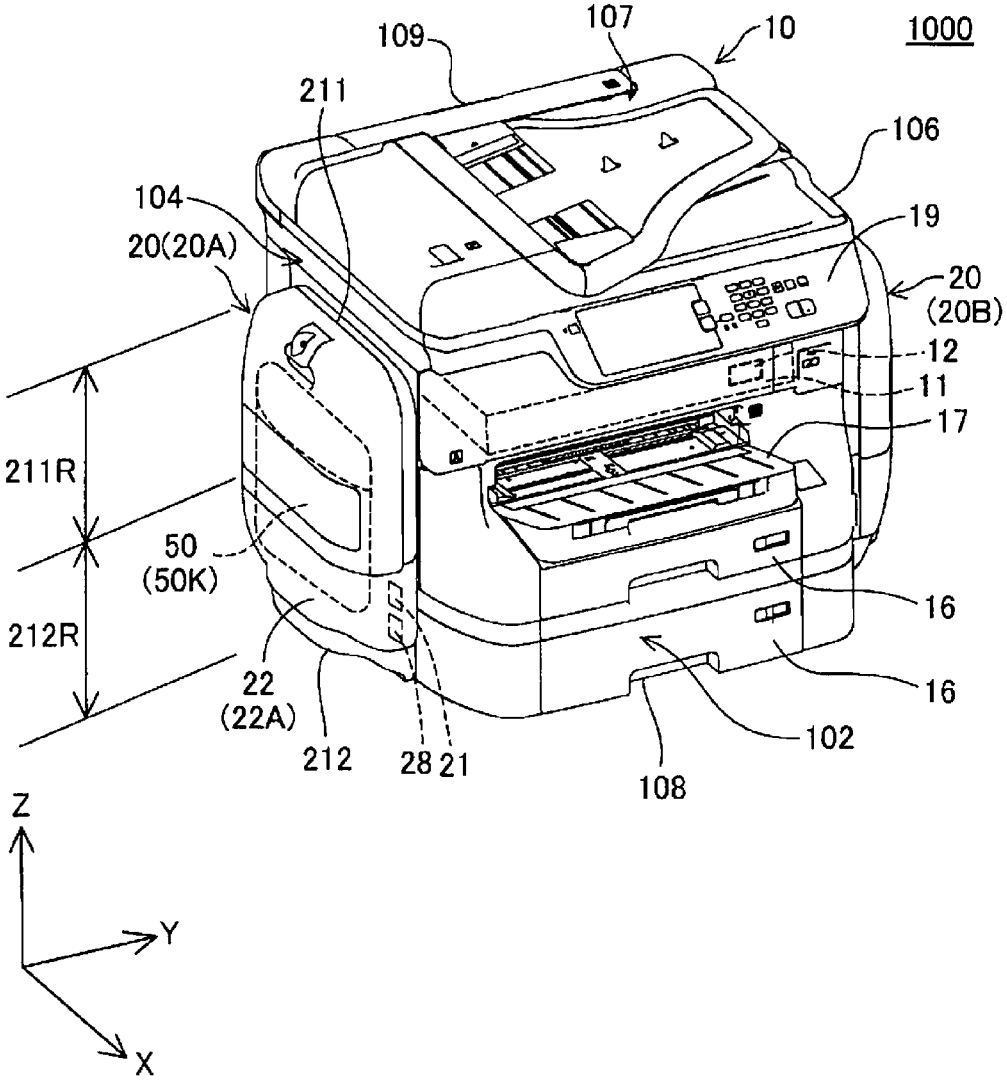
FIG. 1 is a first perspective view of a liquid ejection recording system.
Figure 2:
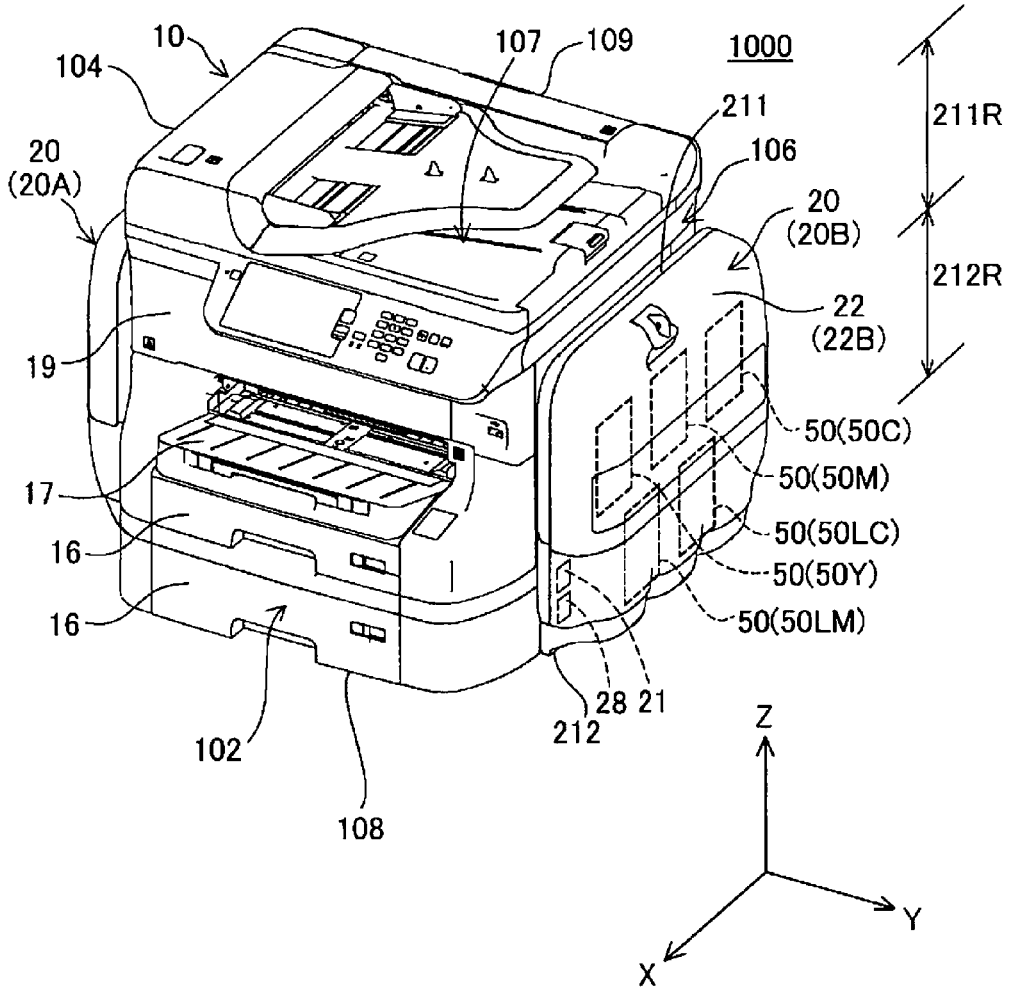
FIG. 2 is a second perspective view of the liquid ejection recording system.
Figure 3:
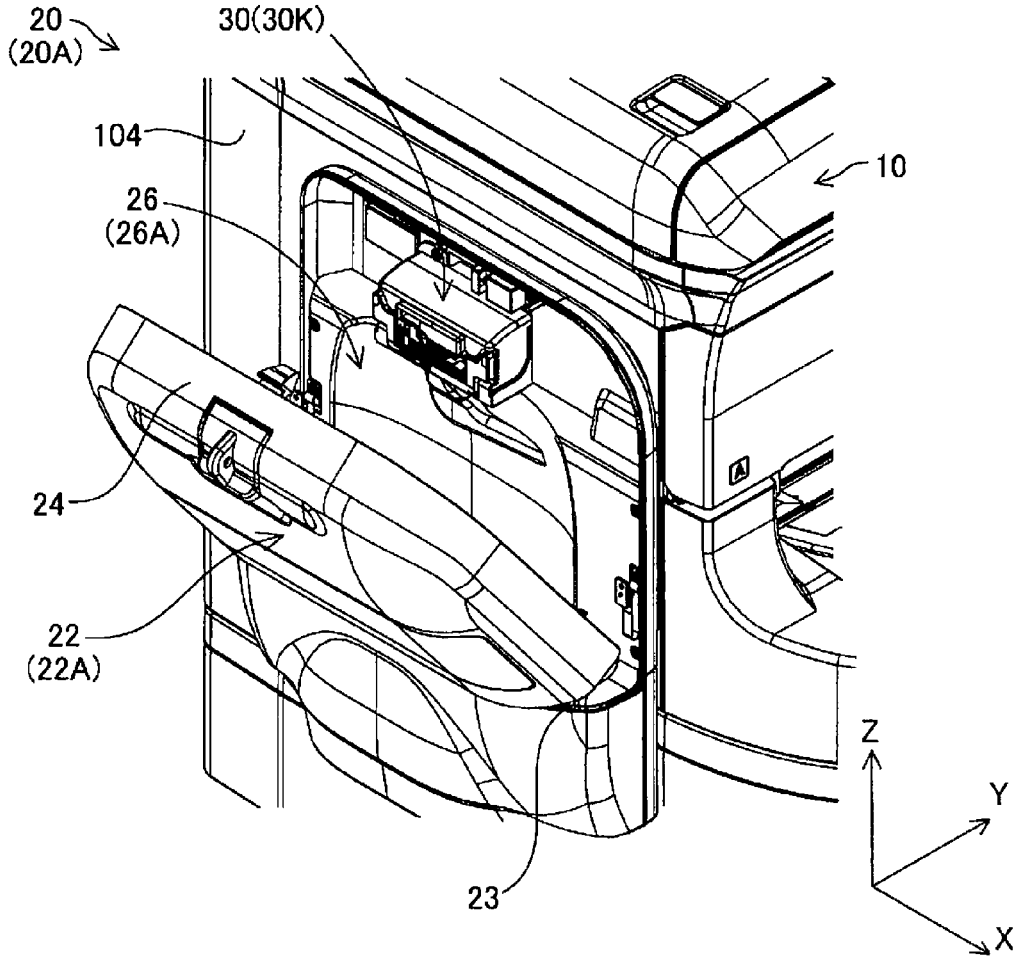
FIG. 3 is a first diagram illustrating a liquid supply apparatus.
Figure 4:
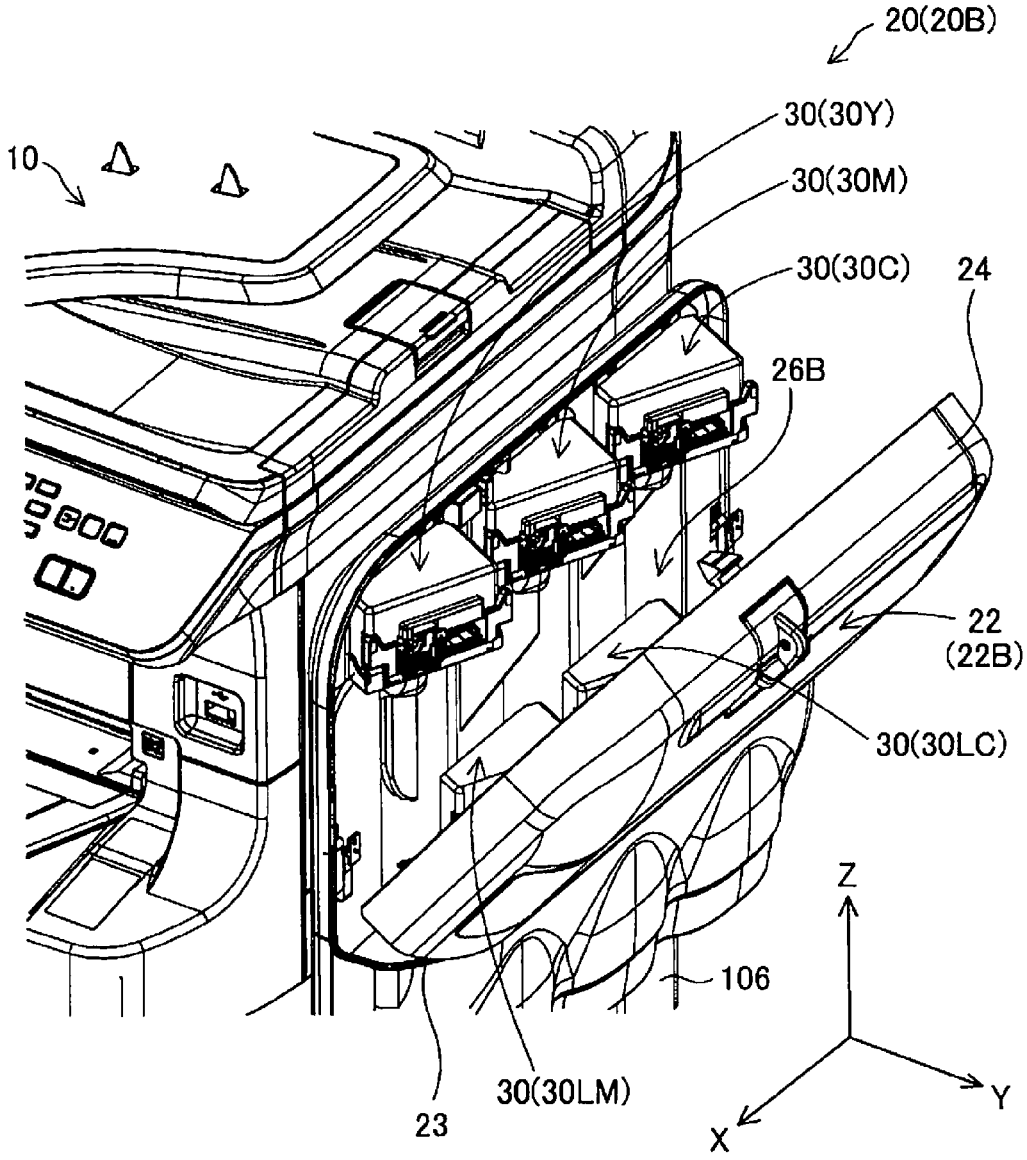
FIG. 4 is a second diagram illustrating the liquid supply apparatus.

A. First Embodiment:

A-1. Configuration of Liquid Ejection Recording System:

FIG. 1 is a first perspective view of a liquid ejection recording system 1000. FIG. 2 is a second perspective view of the liquid ejection recording system 1000. FIG. 3 is a first diagram illustrating a liquid supply apparatus 20. FIG. 4 is a second diagram illustrating the liquid supply apparatus 20. Note that FIG. 3 and FIG. 4 show that a liquid container, which is described below, has been detached. In FIGS. 1-4, XYZ axes that are orthogonal to each other are depicted.

As shown in FIG. 1, the liquid ejection recording system 1000 includes a printer 10, which serves as a liquid ejection recording apparatus, and two liquid supply apparatuses 20. When the liquid ejection recording system 1000 is in the used state, the printer 10 is placed on the horizontal plane defined by the X axis direction and the Y axis direction. In other words, the Z axis direction coincides with the vertical direction (the top-to-bottom direction). −Z axis direction coincides with the vertically downward direction, and the +Z axis direction coincides with the vertically upward direction. Ink as the liquid is supplied from a liquid container 50 of the liquid supply apparatus 20 to the printer 10.

The printer 10 is an inkjet printer. The printer 10 substantially has the shape of a rectangular cuboid. The printer 10 has a front face (first face, first wall) 102, a left side face (first side face, first side wall) 104, a right side face (second side face, second side wall) 106, a rear face (a second face, a second wall) 109, a top face (a third face, a third wall) 107, and a bottom face (a fourth face, a fourth wall) 108. The faces 102, 104, 106, 107, 108, and 109 constitute the outer envelope (housing) of the printer 10.

The front face 102 and the rear face 109 oppose each other. The left side face 104 and the right side face 106 oppose each other. The front face 102, the rear face 109, the left side face 104, and the right side face 106 are substantially perpendicular to the plane on which the printer 10 is placed. The top face 107 and the bottom face 108 oppose each other. The top face 107 and the bottom face 108 are substantially parallel with the plane on which the printer is placed. Each of the left side face 104 and the right side face 106 intersects with the front face 102 and the rear face 109. Here, the terms "substantially perpendicular" and "substantially parallel" includes the meanings of almost "perpendicular" and almost "parallel" in addition to the meaning of perfectly "perpendicular" and perfectly "parallel". In other words, the faces 102, 104, 106, 107, 108, and 109 are not perfectly flat and includes concavities and convexities, etc., and accordingly they may be almost "perpendicular" or almost "parallel" in terms of the appearance.

The X axis direction is the direction in which the front face 102 and the rear face 109 oppose each other. The Y axis direction is the direction in which the left side face 104 and the right side face 106 oppose each other. The Z axis direction is the direction in which the top face 107 and the bottom face 108 oppose each other. The X axis direction is the "depth direction" of the printer 10, the Y axis direction is the "width direction" of the printer 10, and the Z axis direction is the "height direction" of the printer 10.

The printer 10 includes a recording mechanism 11, paper feed cassettes 16, and a discharge tray 17 serving as a recording medium outlet. The plurality of paper feed cassettes 16 are disposed at different heights in the vertical direction (bottom-to-top direction). Each paper feed cassette 16 houses recording media (e.g., sheets of paper) on which images of characters, etc., are printed (recorded) by the printer 10. In this embodiment, two paper feed cassettes 16 are stacked in the vertical direction in a printer body 19. The number of the paper feed cassettes 16 in the printer body 19 may be increased. When an additional paper feed cassette 16 is provided in the printer body 19, the additional paper feed cassette 16 is to be disposed below the existing paper feed cassettes 16, in the vertical direction.

The recording mechanism 11 is disposed inside the printer body 19. The recording mechanism 11 includes a recording head (not shown in the drawing) for discharging (ejecting) the ink, and a control part 12 for controlling the operation of the recording head. The recording head is in communication with the liquid supply apparatus 20. The recording head performs recording (printing) by discharging ink onto a recording medium by using ink supplied from the liquid supply apparatus 20.

The discharge tray 17 is provided in the front face 102. The discharge tray 17 discharges a recording medium on which recording by the recording mechanism 11 is performed.

The two liquid supply apparatuses 20 are attached to the left side face 104 and the right side face 106. Here, the liquid supply apparatus 20 attached to the left side face 104 may also be referred to as "first liquid supply apparatus 20A", and the liquid supply apparatus 20 attached to the right side face 106 may also be referred to as "second liquid supply apparatus 20B". Note that when there is no need to distinguish the first liquid supply apparatus 20A and the second liquid supply apparatus 20B from each other, they may be simply referred to as "liquid supply apparatus 20".

As shown in FIG. 1, the first liquid supply apparatus 20A includes one casing 22, one liquid container 50, and one attachment/detachment unit 30 (FIG. 3). As shown in FIG. 2, the second liquid supply apparatus 20B includes one casing 22, five liquid containers 50, and five attachment/detachment units 30 (FIG. 4) respectively corresponding to the liquid containers 50. Here, when the two casings 22 need to be distinguished from each other, signs "22A" and "22B" are used. Similarly, when the liquid containers 50 need to be distinguished from each other, signs "50K", "50C", "50M", "50Y", "50LM", and "50LC" are used. Similarly, when the attachment/detachment units 30 need to be distinguished from each other, signs "30K", "30C", "30M", "30Y", "30LM", and "30LC" are used. Note that the liquid supply apparatuses 20, the liquid containers 50, and the attachment/detachment units 30 are not limited in number to the above description. For example, the number of casings 22 may be one, and may be three or more. Furthermore, the number of the liquid containers 50 included in one liquid supply apparatus 20 may be one, and may be two or more.

Each of the six liquid containers 50 contains (i.e., is filled with) a different kind of ink. In this embodiment, inks of the color black (K), yellow (Y), magenta (M), cyan (C), light magenta (LM), and light cyan (LC) are respectively stored in the different liquid containers 50. The liquid container 50K has a liquid container part storing the black ink. The liquid container 50C has a liquid container part storing the cyan ink. The liquid container 50M has a liquid container part storing the magenta ink. The liquid container 50Y has a liquid container part storing the yellow ink. The liquid container 50LM has a liquid container part storing the light magenta (pale magenta) ink, and the liquid container 50LC has a liquid container part storing the light cyan (pale cyan) ink.

As shown in FIG. 3 and FIG. 4, each liquid container 50 is housed in a container space part 26 defined by the corresponding casing 22. Specifically, the liquid container 50K is housed in the container space part 26A (FIG. 3), and the liquid containers 50C, 50M, 50Y, 50LM, and 50LC are housed in the container space part 26B (FIG. 4). As shown in FIG. 2, the five liquid containers 50C, 50M, 50Y, 50LM, and 50LC housed in the casing 22B are arranged at multiple levels in the top-to-bottom direction (Z axis direction). A detailed description of the arrangement of the five liquid containers 50C, 50M, 50Y, 50LM, and 50LC within the casing 22B will be given later.

The attachment/detachment units 30 shown in FIG. 3 and FIG. 4 are for detachably attaching the liquid containers 50. In other words, the liquid container 50 is detachably housed in the casing 22. The attachment/detachment unit 30K is disposed inside the casing 22A, and the attachment/detachment units 30C, 30M, 30Y, 30LM, and 30LC are disposed inside the casing 22B. As shown in FIG. 3, the attachment/detachment unit 30K is disposed in the left side face 104 of the printer 10. As shown in FIG. 4, the attachment/detachment units 30C, 30M, 30Y, 30LM, and 30LC are disposed in the right side face 106 of the printer 10. When the liquid container 50 is attached to the attachment/detachment unit 30, a supply mechanism (not shown in the drawing) of the printer 10, which has the function of a pump, sucks up the ink stored in the liquid container 50, thereby supplying the ink to the recording head of the printer 10.

As shown in FIG. 3, the casing 22A is supported at the left side face 104 of the printer 10 by being attached thereto by a fixing member such as a screw. As shown in FIG. 4, the casing 22B is supported at the right side face 106 of the printer 10 by being attached thereto by a fixing member such as a screw. Note that the method for supporting the casing 22 to the printer 10 is not limited to the above description, and any method may be adopted as long as the position of the casing 22 can be fixed by being supported by the printer 10. For example, it is possible to provide the casing 22 with a casing-side engagement part such as a claw, and also provide the side faces 104 and 106 of the printer 10 with an apparatus-side engagement part such as a groove. If this is the case, the casing 22 can be supported at the side faces 104 and 106 of the printer 10 by fitting the casing-side engagement part into the apparatus-side engagement part.

The casing 22 is configured to be freely openable and closable by rotating a vertically upper end portion 24 about a pivot part 23. After the ink stored in the liquid container 50 is consumed, the user opens the casing 22 and detaches the consumed liquid container 50 from the attachment/detachment unit 30. Then, the user attaches a new liquid container 50 to the attachment/detachment unit 30, and closes the casing 22.

As shown in FIG. 1 and FIG. 2, the casing 22 includes a member relay part 21 and a wiring relay part 28. The member relay part 21 is an opening (through-hole) formed in the wall surface of the casing 22 on the side of the wall surfaces 104 and 106 of the printer 10 on which the casing 22 is supported. The member relay part 21 is a part for guiding a flow passage part (described later) for supplying the ink provided in the liquid supply apparatus 20 to the liquid ejection head in the printer 10. The flow passage part passes through the member relay part 21, which is an opening, and is then connected to the recording head of the printer 10. The member relay part 21 on the side of the second liquid supply apparatus 20B is a single member for guiding a plurality of flow passage members (five members in this embodiment), which are provided in correspondence with the plurality of liquid containers 50 (five containers in this embodiment), to the recording head of the printer 10.

The member relay part 21 is located in a lower end portion 212R, which includes a lower edge 212, of the casing 22. The lower end portion 212R is the region that is located on the lower side from the center of the casing 22 with respect to the top-to-bottom direction (Z axis direction). Note that the member relay part 21 is preferably located near the lower edge 212 of the lower end portion 212R. In another embodiment, the member relay part 21 may be located in an upper end portion 211R, which includes an upper edge 211, of the casing 22. The upper end portion 211R is the region that is located on the upper side from the center of the casing 22 with respect to the top-to-bottom direction (Z axis direction). Note that when the member relay part 21 is located in the upper end portion 211R, the member relay part 21 is preferably located near the upper edge 211 of the upper end portion 211R.

The wiring relay part 28 is an opening (through-hole) formed in the casing wall surface of the casing 22 on the side of the wall surfaces 104 and 106 of the printer 10 on which the casing 22 is supported. The wiring relay part 28 is a part for guiding an electrical wire (described later) provided in the liquid supply apparatus 20 to the inside of the printer 10. The electrical wire passes through the wiring relay part 28, which is an opening, and is then electrically connected to the control part 12 of the printer 10. The wiring relay part 28 on the side of the second liquid supply apparatus 20B is a single member for guiding a plurality of wires (five wires in this embodiment), which are provided in correspondence with the plurality of liquid containers 50 (five containers in this embodiment), to the inside of the printer 10, which is outside the liquid supply apparatus 20B.

The wiring relay part 28 is located in the lower end portion 212R, which includes the lower edge 212, of the casing 22. Note that the wiring relay part 28 is preferably located near the lower edge 212 of the lower end portion 212R. In another embodiment, the wiring relay part 28 may be located in the upper end portion 211R, which includes the upper edge 211, of the casing 22B. Note that when the wiring relay part 28 is located in the upper end portion 211R, the wiring relay part 28 is preferably located near the upper edge 211 of the upper end portion 211R.

Figure 5:
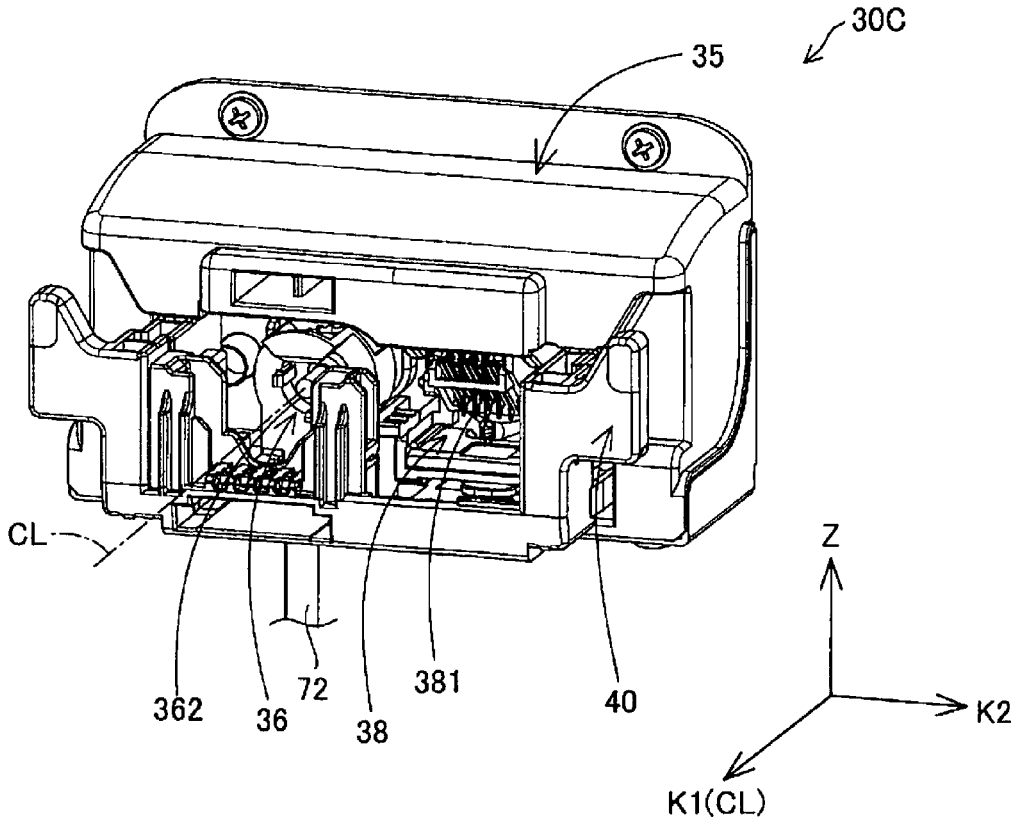
FIG. 5 is a first perspective view of an attachment/detachment unit.
Figure 6:
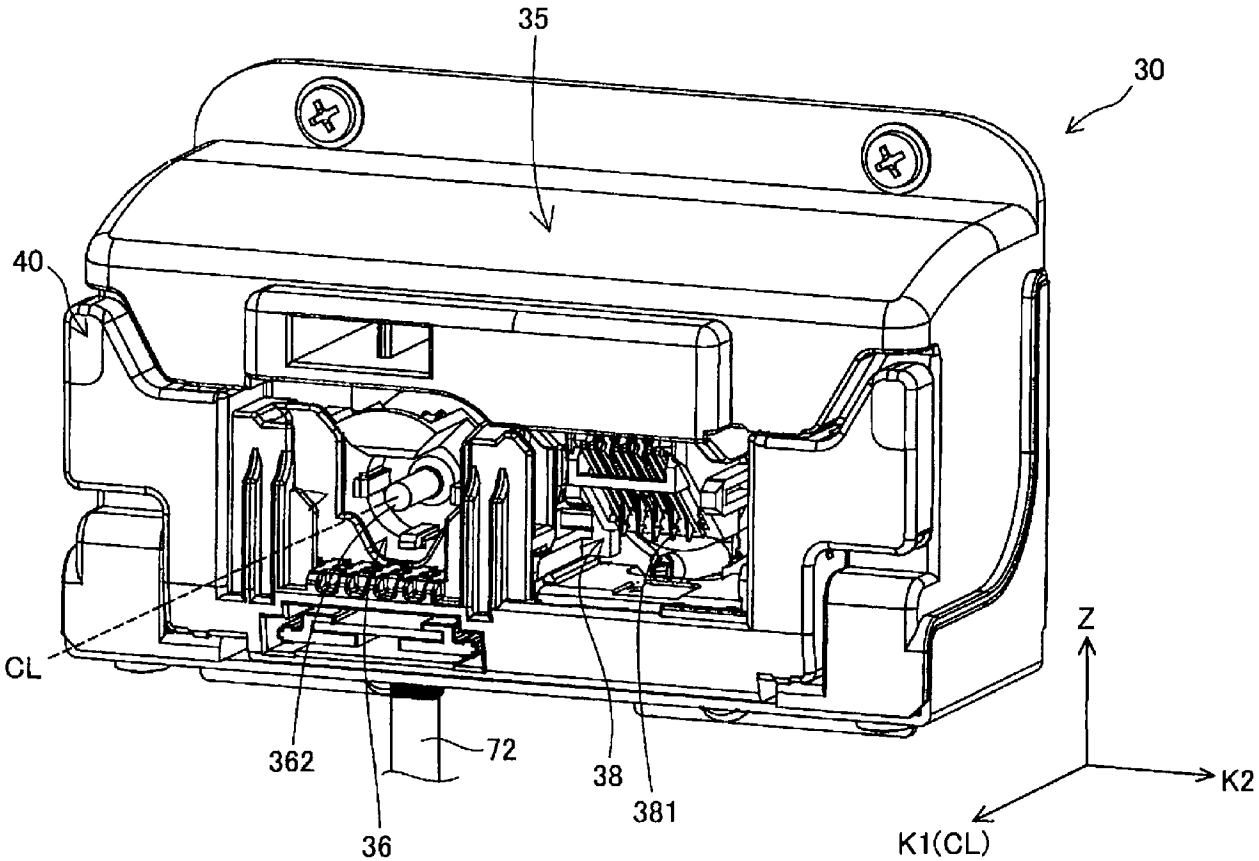
FIG. 6 is a second perspective view of the attachment/detachment unit.
Figure 7:
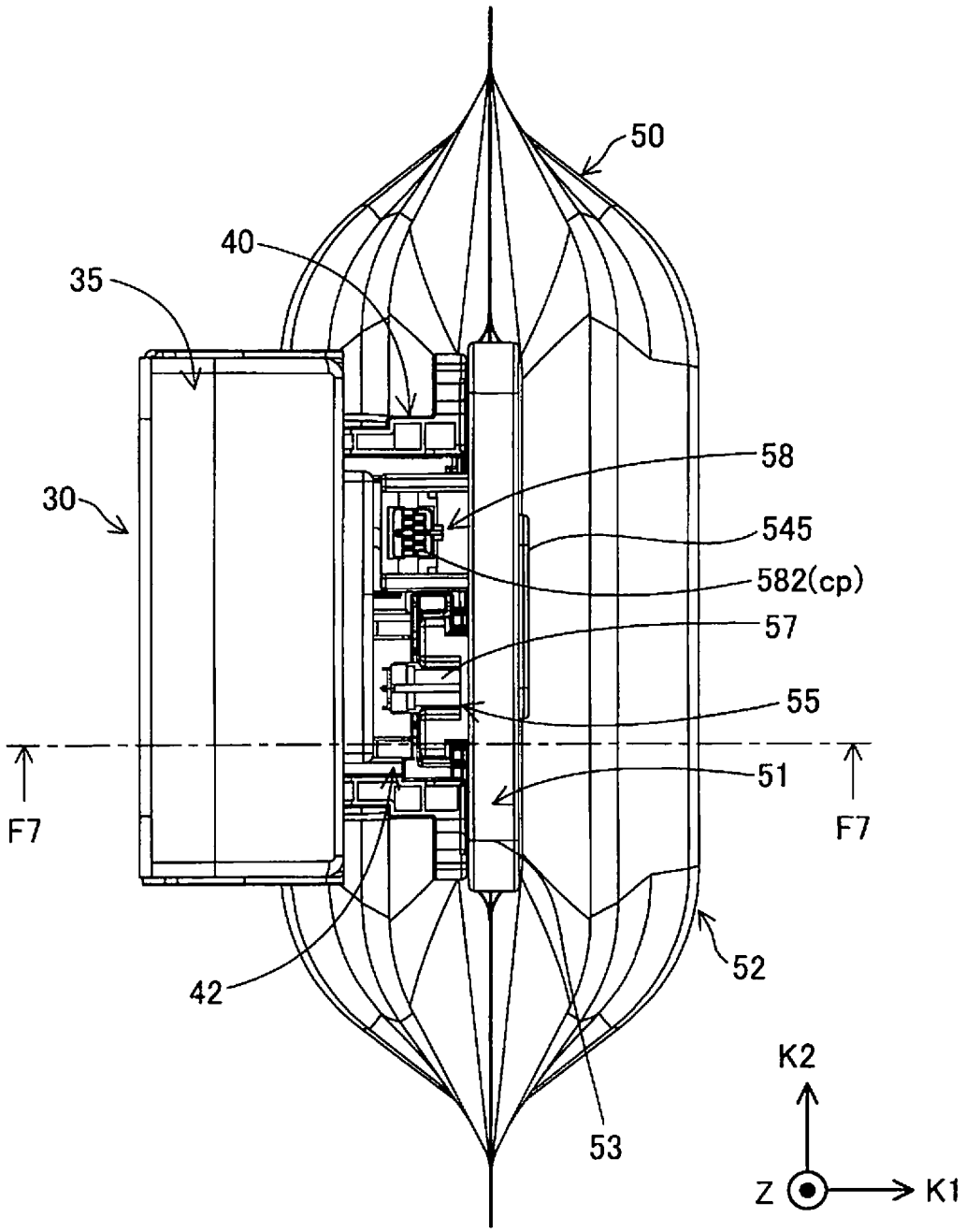
FIG. 7 is a top view of FIG. 5.
Figure 8:
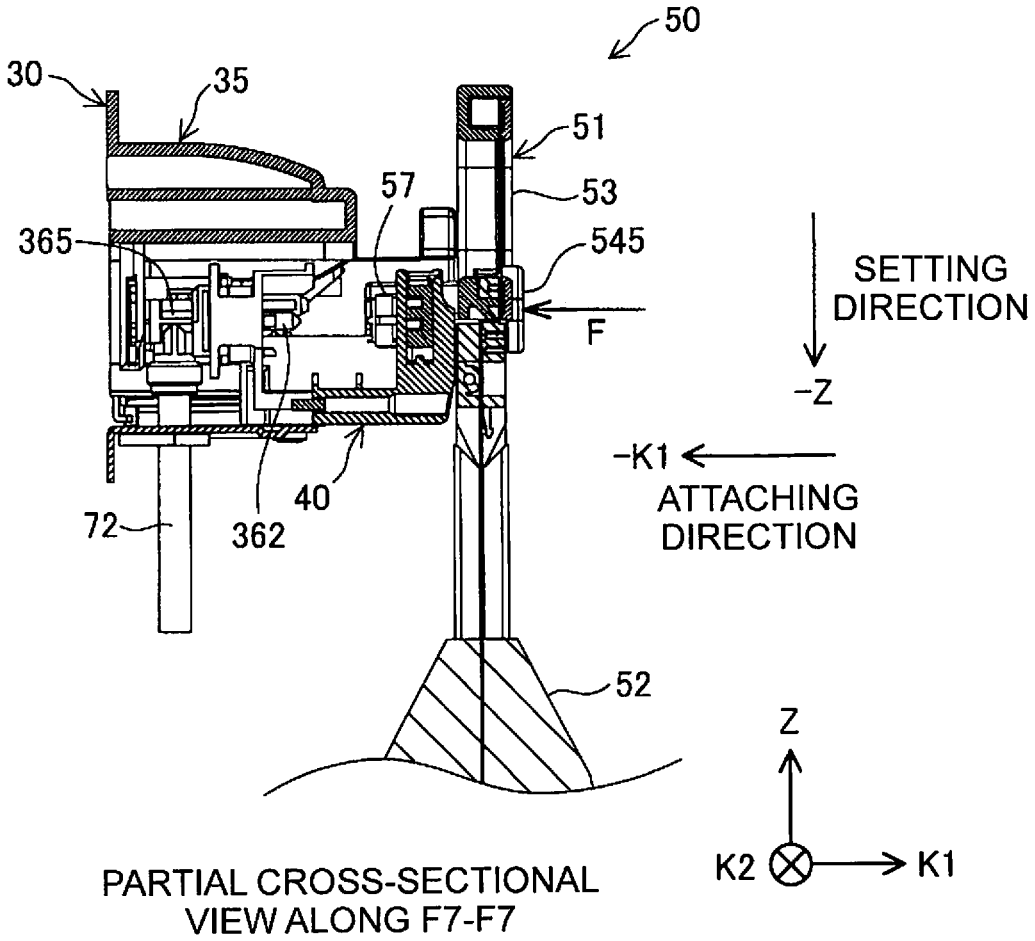
FIG. 8 is a partial cross-sectional view along F7-F7 in FIG. 7.
Figure 9:
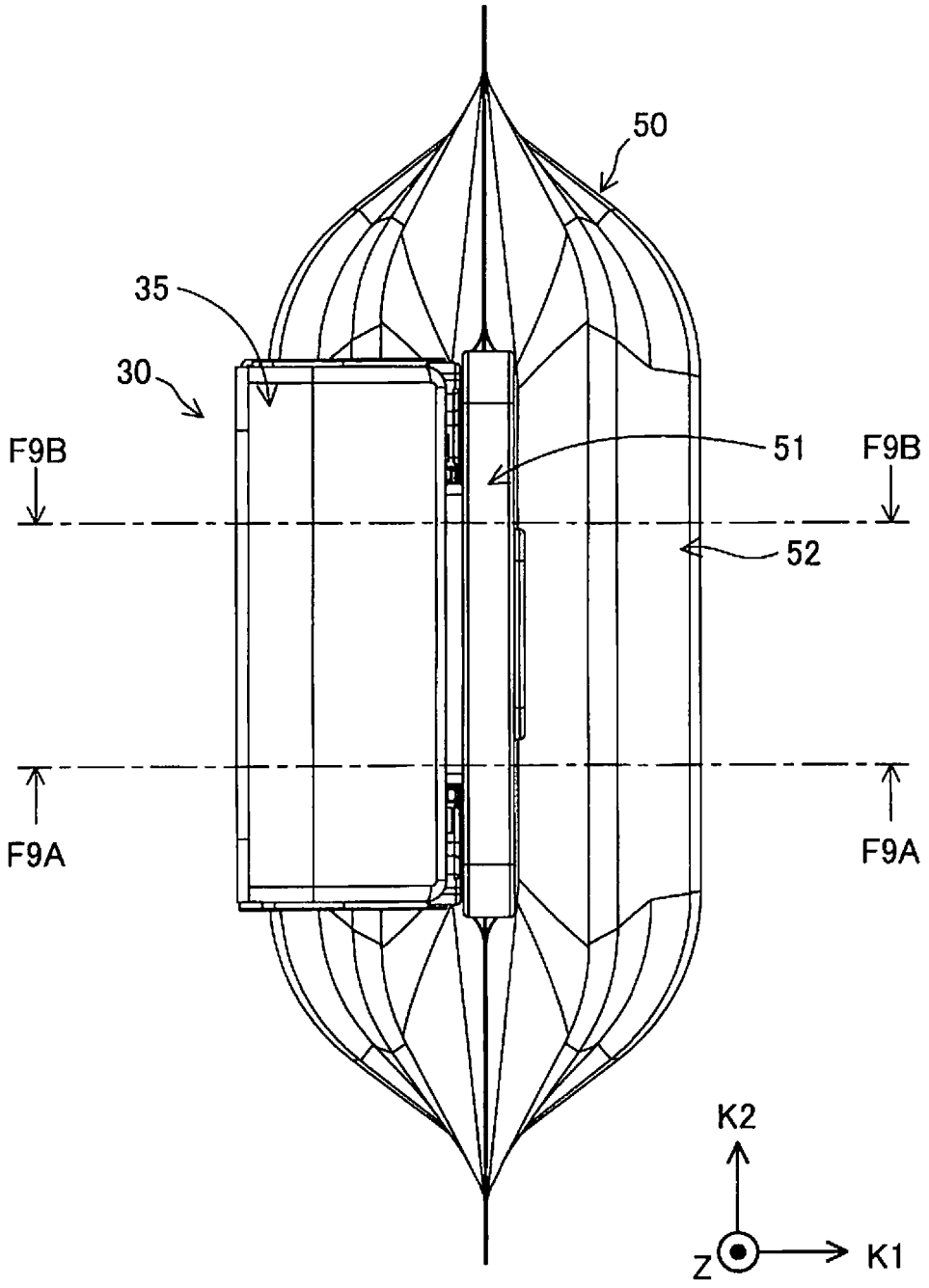
FIG. 9 is a top view of FIG. 6.
Figure 10A:
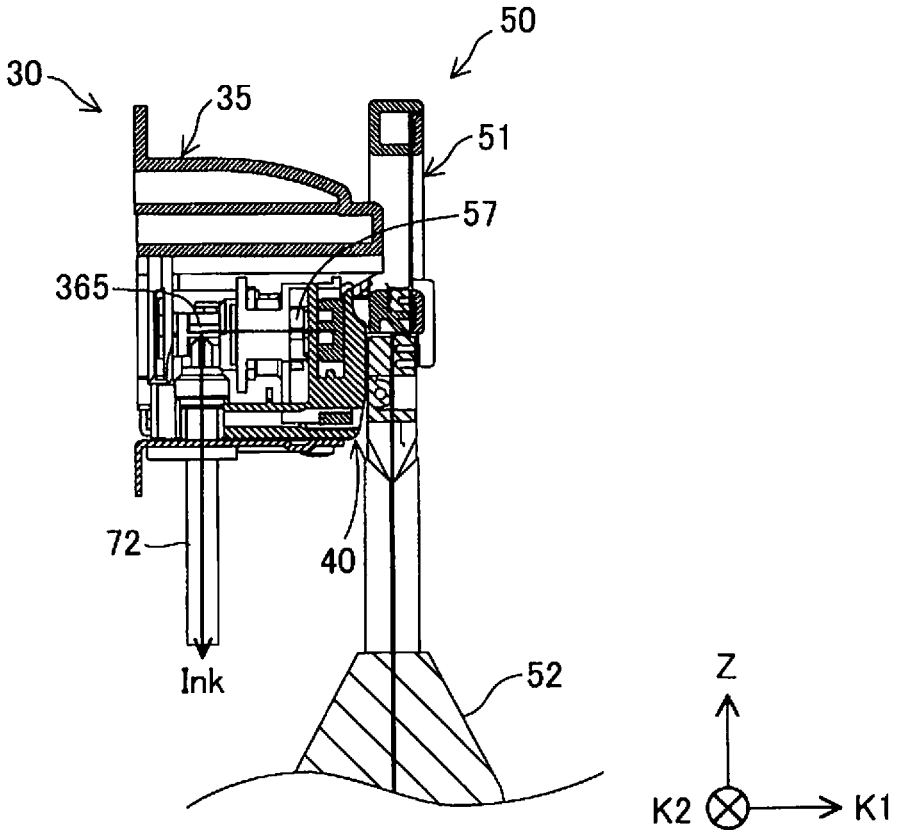
FIG. 10A is a partial cross-sectional view along F9A-F9A in FIG. 9.
Figure 10B:
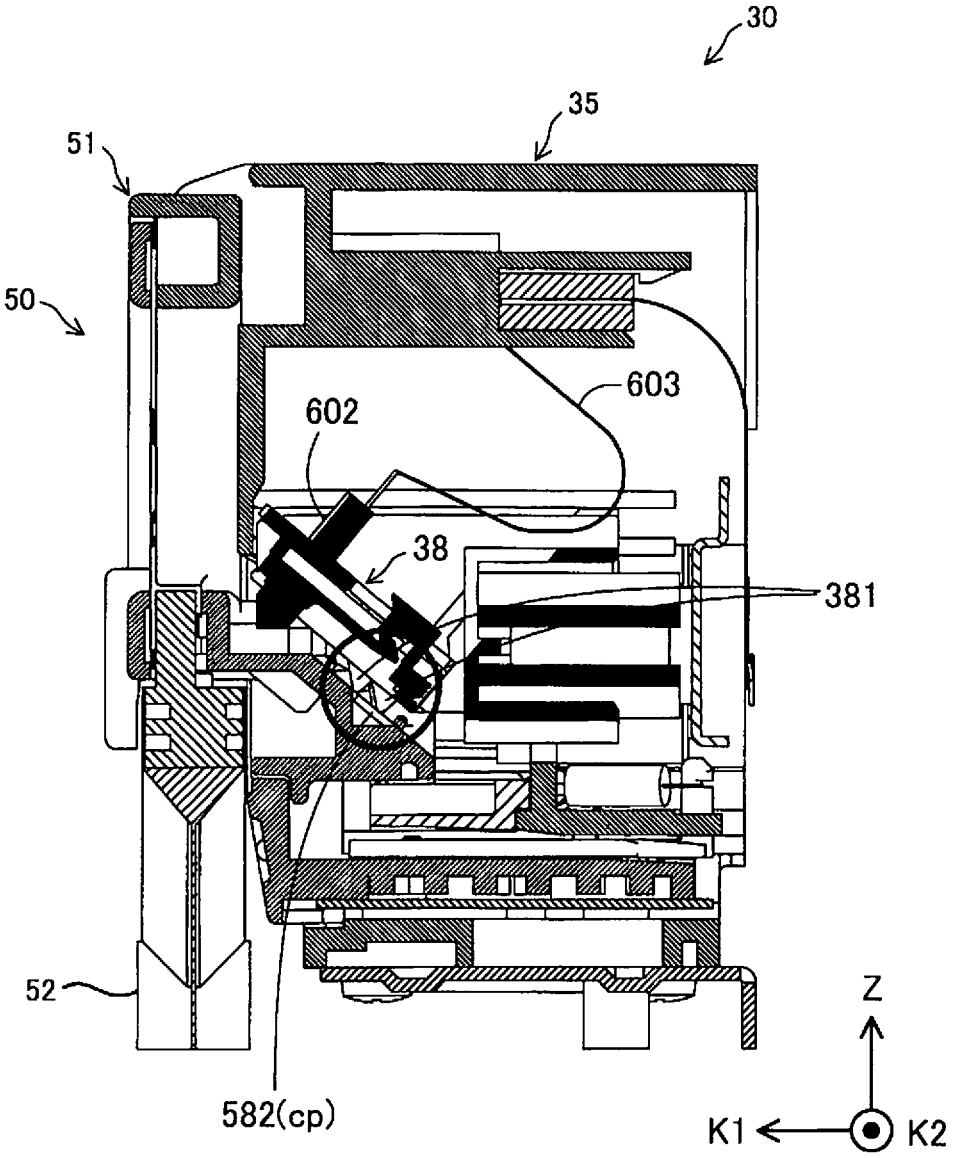
FIG. 10B is a partial cross-sectional view along F9B-F9B in FIG. 9.

A-2. Configuration of Attachment/Detachment Unit 30:

FIG. 5 is a first perspective view of the attachment/detachment unit 30. FIG. 6 is a second perspective view of the attachment/detachment unit 30. FIG. 7 is a top view of FIG. 5. FIG. 8 is a partial cross-sectional view along F7-F7 in FIG. 7. FIG. 9 is a top view of FIG. 6. FIG. 10A is a partial cross-sectional view along F9A-F9A in FIG. 9. FIG. 10B is a partial cross-sectional view along F9B-F9B in FIG. 9. FIG. 5 shows a first state (setting state) in which a movable supporting part (movable member) 40 projects outward by the greatest distance from a fixing member 35. FIG. 6 shows a second state (attached state) in which the movable member 40 is housed in the fixing member 35. FIG. 7 to FIG. 10B also show the liquid container 50 supported by the attachment/detachment unit 30. FIG. 5 to FIG. 10B show K1 axis, K2 axis, and the Z axis, which are orthogonal to each other. The drawings following the above also show the K1 axis, the K2 axis, and the Z axis as needed.

The attachment/detachment unit 30K (FIG. 3) and the attachment/detachment units 30C, 30M, 30Y, 30LM, and 30LC (FIG. 4) are different in the attachment angle with respect to the side faces 104 and 106 to which they are attached (i.e., the orientation with respect to the K1 axis direction and the orientation with respect to the K2 axis direction). They have the same configuration with respect to other elements. The attachment/detachment units 30C, 30M, 30Y, 30LM, and 30LC have the same configuration. The following describes the configurations of the attachment/detachment units 30C, 30M, 30Y, 30LM, and 30LC, as well as unique features in the configuration of the attachment/detachment unit 30K.

As shown in FIG. 5 and FIG. 6, the attachment/detachment unit 30 includes a fixing member (fixing part) 35, the movable member 40, and a flow passage member 72 as a tube for example. The fixing member 35 is supported by the casing 22 by being attached to the casing 22 by an attachment member such as a screw. The movable member 40 is supported by the fixing member 35 so as to be movable with respect to the fixing member 35. In other words, the fixing member 35 guides the movement of the movable member 40 in the first direction (−K1 axis direction) or the second direction (+K1 axis direction). The first direction is the attaching direction in which the liquid container 50 is attached, and the second direction is the detaching direction in which the liquid container 50 is detached.

As shown in FIG. 6, the fixing member 35 includes a liquid introduction mechanism 36 and a contact mechanism 38. The liquid introduction mechanism 36 and the contact mechanism 38 are arranged next to each other along the K2 axis direction.

As shown in FIG. 8, the liquid introduction mechanism 36 includes a liquid introduction part 362 and a connection part 365. The liquid introduction part 362 is in communication with the recording head of the printer 10. The liquid introduction part 362 is connected to a liquid supply part 57 of the liquid container 50. The liquid introduction part 362 has the shape of a needle, and the ink can pass through the inside thereof. As shown in FIG. 5, the liquid introduction part 362 has a central axis CL, and has the shape of a cylinder extending along the central axis CL.

The upstream end portion of the connection part 365 in the direction of the flow of the ink from the liquid container 50 to the printer 10 is connected to the liquid introduction part 362, and the downstream end portion thereof is connected to the flow passage member 72. The ink flowing through the liquid introduction part 362 flows into the connection part 365.

The flow passage member 72 is a flexible member. In this embodiment, the flow passage member 72 is a hose, and ink can be distributed through the inside thereof. The flow passage member 72 is flexible and can be bent. The flow passage member 72 passes through the member relay part 21 (FIG. 1 and FIG. 2), and the downstream end portion is connected to the recording head. Therefore, the ink that has passed through the liquid introduction part 362 flows through the connection part 365 and the flow passage member 72 in this order, and is then supplied to the recording head. Such a flow of the ink is shown in FIG. 10A.

As shown in FIG. 6, the contact mechanism 38 includes a plurality of apparatus-side terminals 381, which serve as apparatus-side electrical connection parts. The plurality of apparatus-side terminals 381 are electrically connected to a circuit substrate 582 by being brought into contact with contact parts cp, which serve as container-side electrical connection parts, of the circuit substrate 582 (FIG. 7) of the liquid container 50. In this embodiment, nine apparatus-side terminals 381 are provided in correspondence with nine contact parts cp.

Here, it is assumed that the direction along the central axis CL (the direction in which the liquid introduction part 362 extends) is the K1 axis direction. The K1 axis direction is orthogonal to the Z axis direction and the K2 axis direction. The plane defined by the K1 axis direction and the K2 axis direction is parallel with the plane defined by the X axis direction and the Y axis direction shown in FIG. 1. With respect to the K1 axis direction, the direction toward the outside of the printer 10 is defined as +K1 axis direction, and the direction toward the inside of the printer 10 is defined as −K1 axis direction. As shown in FIG. 5 and FIG. 6, the movable member 40 is supported by the fixing member 35 so as to be movable in the K1 axis direction with respect to the fixing member 35. The −K1 axis direction is the direction in which the movable member 40 gets closer to the fixing member 35, and the +K1 axis direction is the direction in which the movable member 40 gets away from the fixing member 35.

The attachment/detachment unit 30K is attached to the casing 22A such that the K2 axis direction will be parallel with the X axis direction. In contrast, the attachment/detachment units 30C, 30M, 30Y, 30LM, and 30LC are attached to the casing 22B such that the K2 axis direction is not parallel with the X axis direction, but forms a predetermined angle (e.g., 15°) with the X axis direction.

The liquid container 50 is attached to the attachment/detachment unit 30 by the following two operations. The state in which the liquid container 50 is attached to the attachment/detachment unit 30 is also referred to as "attached state". The attached state is the state in which the liquid supply part 57 (FIG. 7) of the liquid container 50 is connected to the liquid introduction part (liquid introducing needle) 362 of the attachment/detachment unit 30, and the circuit substrate 582 (FIG. 7) of the liquid container 50 is electrically connected to the apparatus-side terminals 381 of the attachment/detachment unit 30. In the attached state, the supply mechanism of the printer 10 can be started up, and accordingly the ink stored in the liquid container 50 is made ready to be distributed to the printer 10.

First Operation (Setting Operation):

After putting the attachment/detachment unit 30 into the first state, the user moves the liquid container 50 in the setting direction, and sets it to the movable member 40 (FIG. 7 and FIG. 8).

Second Operation (Connecting Operation):

After the first operation, the user pushes the movable member 40 toward the fixing member 35 via the liquid container 50, thereby putting the attachment/detachment unit 30 into the second state (FIG. 9 and FIG. 10A).

As shown in FIG. 8, the setting direction is the direction including the downward component of the gravity. In this embodiment, the setting direction is the downward gravity direction. The second operation is an operation for moving the movable member 40 in the −K1 axis direction.

As shown in FIG. 7 and FIG. 8, after putting the attachment/detachment unit 30 into the first state, the user sets the liquid container 50 at a predetermined position of the movable member 40. In the state (setting state) where the liquid container 50 is set, the circuit substrate 582 of a substrate unit 58 of the liquid container 50 is positioned so as to oppose the apparatus-side terminals 381. Also, in the setting state, the liquid supply part 57 of a liquid supply unit 55 included in the liquid container 50 is positioned so as to oppose the liquid introduction part 362. Also, as shown in FIG. 8, in the setting state, the liquid container 50 is supported by the movable member 40 such that the liquid container part 52 is positioned lower in the gravity direction than a container part supporting assembly 51.

After the liquid container 50 is set to the movable member 40, the user presses the liquid container 50 toward the −K axis direction, as indicated by the arrow F in FIG. B. Thus, the liquid container 50 and the movable member 40 are moved in the attaching direction (−K1 axis direction). As shown in FIG. 10A, when the attachment/detachment unit 30 is in the second state, the liquid introduction part 362 is inserted (connected) to the inside of the liquid supply part 57. Also, in the second state, as shown in FIG. 10B, the contact parts cp of the circuit substrate 582 and the apparatus-side terminals 381 are brought into contact, and thus the circuit substrate 582 and the apparatus-side terminals 381 are electrically connected.

When the attachment/detachment unit 30 is in the second state, the movement of the movable member 40 toward the +K1 axis direction with respect to the fixing member 35 is regulated by a lock mechanism (not shown in the drawings) of the attachment/detachment unit 30. Note that in the second state, the lock mechanism is unlocked by the movable member 40 being pressed against the fixing member 35 in the inward direction (−K1 axis direction, the first direction). Thus, the state of the attachment/detachment unit 30 can be switched from the second state to the first state by moving the movable member 40 so as to project outward (in the +Z axis direction) from the fixing member 35.

As shown in FIG. 9 and FIG. 10A, the liquid container 50 is positioned within the casing 22 by being attached to the attachment/detachment unit 30 such that the liquid supply part 57 is located above the level of the liquid container part 52 (Specifically, the space in which the ink in the liquid container part 52 is stored).

Also, as shown in FIG. 10B, the liquid container 50 is positioned within the casing 22 by being attached to the attachment/detachment unit 30 such that the contact parts cp are located above the level of the liquid container part 52 (Specifically, the space in which the ink in the liquid container part 52 is stored).

As shown in FIG. 10B, the contact mechanism 38 further includes a connector 602 electrically connected to the apparatus-side terminals 381, and a wire 603 electrically connected to the connector 602. The wire 603 passes through the wiring relay part 28 (FIG. 1 and FIG. 2), and is electrically connected to the control part 12 (FIG. 1) of the printer 10. Note that the respective electric wires 603 of the five contact mechanisms 38 housed in the casing 22B are integrated into one wire via a relay substrate (not shown in the drawings) provided in the casing 22B. This integrated wire passes through the wiring relay part 28 and is electrically connected to the control part 12. Note that the relay substrate may be omitted.

Figure 11:
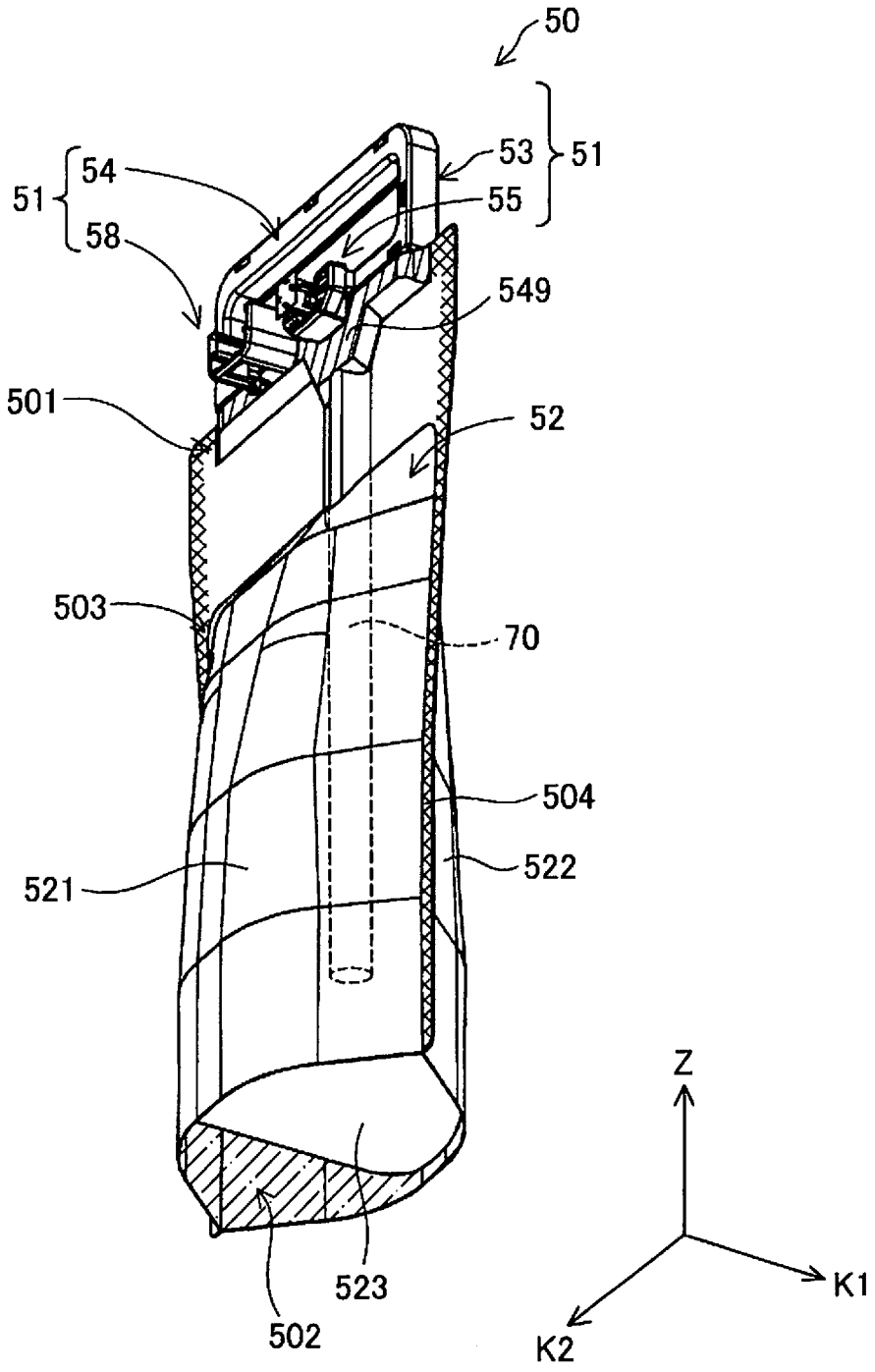
FIG. 11 is a perspective view of a liquid container.
Figure 12:
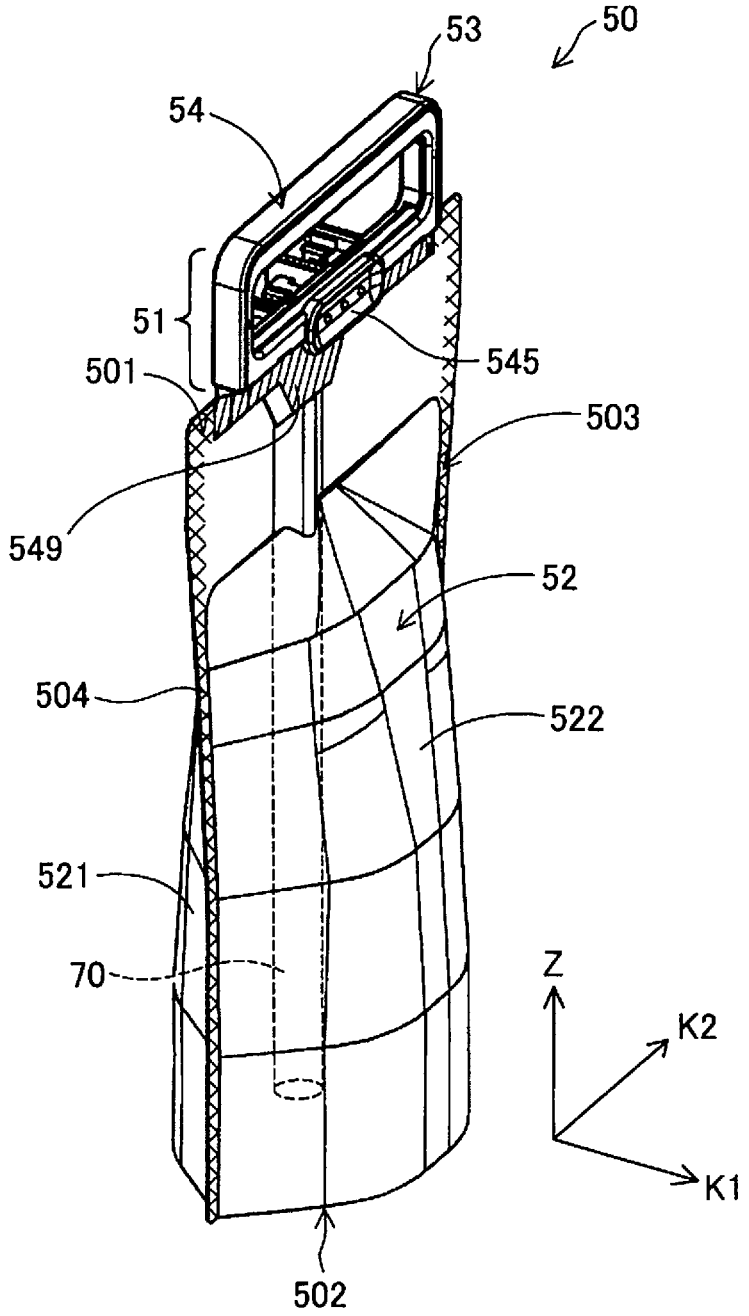
FIG. 12 is a perspective view of the liquid container.
Figure 13:
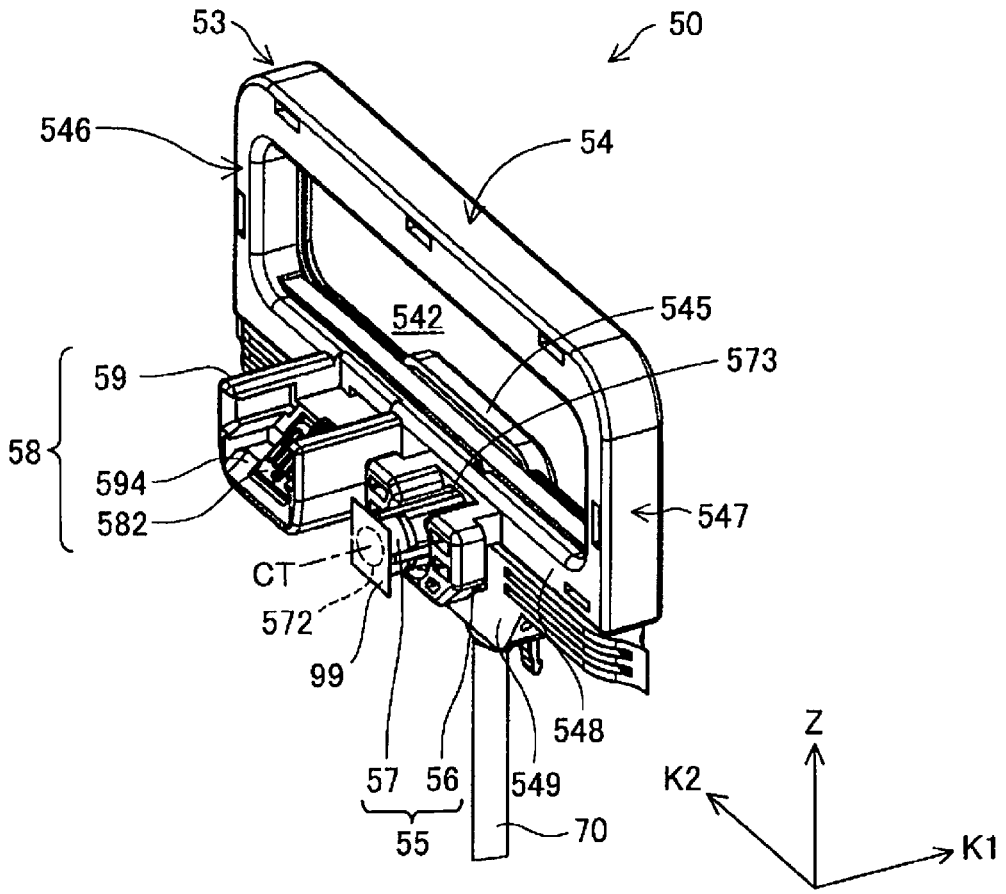
FIG. 13 is a diagram illustrating the liquid container.
Figure 14:
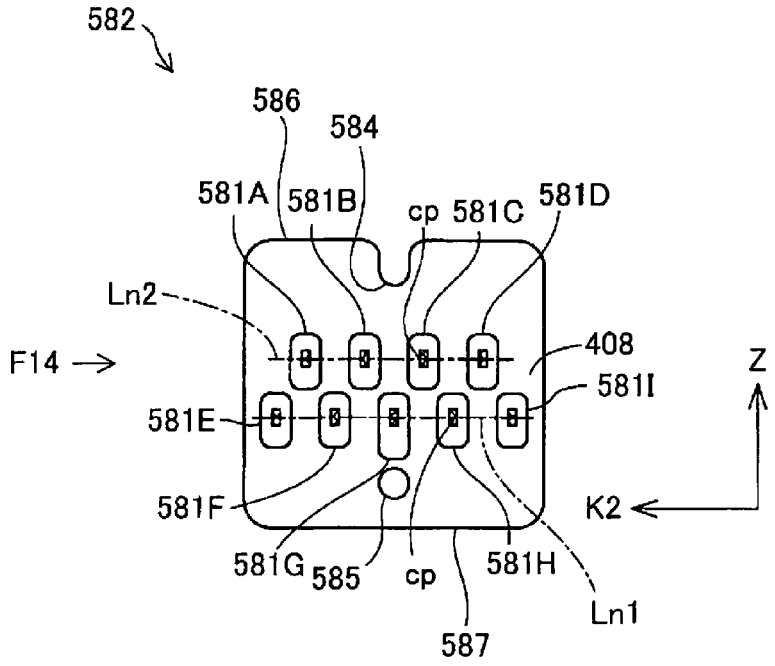
FIG. 14 is a diagram illustrating a circuit substrate.
Figure 15:
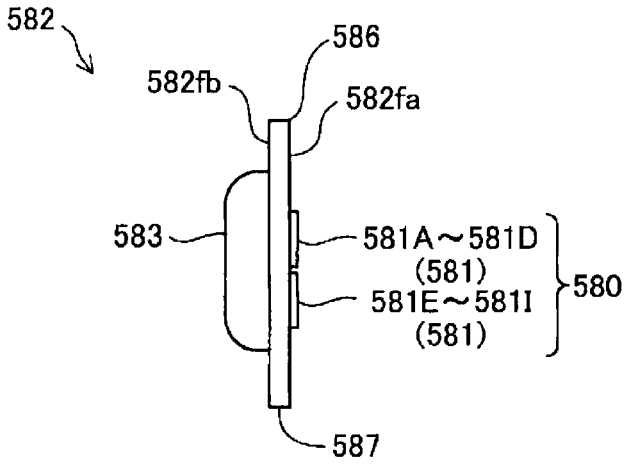
FIG. 15 is a view in the direction of arrow F14 in FIG. 14.

A-3. Configuration of Liquid Container 50:

FIG. 11 is a perspective view of the liquid container 50. FIG. 12 is a perspective view of the liquid container 50. FIG. 13 is a diagram illustrating the liquid container 50. FIG. 14 is a diagram illustrating the circuit substrate 582. FIG. 15 is a view in the direction of arrow F14 in FIG. 14. FIG. 13 is a diagram showing the liquid container 50 from which the liquid container part 52 has been removed.

The liquid container 50K (FIG. 1) and the liquid containers 50C, 50M, 50Y, 50LM, and 50LC (FIG. 2) are different in the capacity of the liquid container part 52. The liquid container part 52 of the liquid container 50K is greater in capacity than the liquid container parts 52 of the liquid containers 50C, 50M, 50Y, 50LM, and 50LC, and is capable of storing a larger amount of ink. In this embodiment, the liquid container part 52 of the liquid container 50K is greater in length in the Z axis direction and in the K2 axis direction than the liquid container parts 52 of the liquid containers 50C, 50M, 50Y, 50LM, and 50LC. The liquid container 50K and the liquid containers 50C, 50M, 50Y, 50LM, and 50LC have the same configuration with respect to other elements. The respective liquid container parts 52 of the liquid containers 50C, 50M, 50Y, 50LM, and 50LC have the same external shape, and are capable of storing the same volume of ink. Note that the capacities of the respective liquid container parts 52 of the liquid containers 50C, 50M, 50Y, 50LM, and 50LC are not necessarily the same, and may be different. For example, the liquid container part 52 of the liquid container 50 storing the ink that is used frequently may have a greater capacity than the liquid container part 52 of the liquid container 50 storing the ink that is used not frequently.

The Z axis direction, the K1 axis direction, and the K2 axis direction can be defined as follows. When the liquid container 50 is in the attached state, the Z axis direction is the direction of gravity (vertical direction). The +Z axis direction is the upward gravity direction (vertically upward direction), and the −Z axis direction is the downward gravity direction (vertically downward direction). The K1 axis direction is the horizontal direction. The −K1 axis direction is the attaching direction (the first direction) in which the liquid container 50 is attached to the printer 10 after the liquid container 50 is set to the attachment/detachment unit 30. The +K1 axis direction is the detaching direction in which the liquid container 50 is detached from the printer 10. Although the attaching direction in this embodiment is the −K1 axis direction, which is the horizontal direction, this is not essential. The attaching direction only needs to be the direction including a horizontal direction component. The K2 axis direction is the direction that is orthogonal to the direction of gravity (Z axis direction) and the K1 axis direction. The Z axis direction is the "height direction" of the liquid container 50. The K1 axis direction is the "thickness direction" of the liquid container 50. The K2 axis direction is the "width direction" of the liquid container 50.

As shown in FIG. 11, the liquid container 50 includes the container part supporting assembly 51, the liquid container part 52 and a flow channel forming member 70. The container part supporting assembly 51 includes a handle part 53, the liquid supply unit 55, and the substrate unit 58. The handle part 53 is a member having the shape of a frame having an opening facing toward the K1 axis direction.

The liquid container part 52 is capable of storing ink. The liquid container part 52 is attached to the container part supporting assembly 51, with the external surface being exposed. In other words, the liquid container part 52 is not housed in a casing or the like, and is configured to be externally visible. The liquid container part 52 is flexible, and the capacity thereof decreases as the ink stored therein decreases.

The liquid container part 52 includes a first sheet 521 (FIG. 11), a second sheet 522 (FIG. 12), and a third sheet 523 (FIG. 11). The first sheet 521 to the third sheet 523 partition the space for storing the ink therein. When the liquid container 50 is in the attached state, the third sheet 523 constitutes the bottom part of the liquid container part 52. Also, in the attached state, each of the first sheet 521 and the second sheet 522 constitutes a side face part of the liquid container part 52.

Here, as shown in FIG. 11, of the liquid container part 52, the portion to which the container part supporting assembly 51 is attached is defined as one end portion (upper end portion) 501, and the part opposing the one end portion 501 is defined as the other end portion (bottom end portion) 502. Also, of the liquid container part 52, the portion on one side (in the +K2 axis direction) is defined as a first side end portion 503, and the portion on the other side (in the −K2 axis direction) is defined as a second side end portion 504.

The respective peripheral areas of the first sheet 521 and the second sheet 522 are partially fused to each other. More specifically, their respective peripheral areas are fused at the one end portion 501, the first side end portion 503, and the second side end portion 504. To facilitate understanding, in FIG. 11 and FIG. 12, the area where the first sheet 521 and the second sheet 522 are fused to each other is indicated by cross hatching. To the one end portion 501 of the liquid container part 52, the container part supporting assembly 51 (specifically, an attaching part 549) is fused. To facilitate understanding, in FIG. 11 and FIG. 12, the area where the container part supporting assembly 51, the first sheet 521, and the second sheet 522 are fused is indicated by single hatching with solid lines.

As shown in FIG. 11, the third sheet 523 is fused to portions of the respective peripheral areas of the first sheet 521 and the second sheet 522. These fused portions are indicated by single hatching with dot-and-dash lines. As described above, the liquid container part 52 according to this embodiment is of the type with three sheets 521, 522, and 523 attached to each other by fusing or the like (so-called a pouch type with a bottom).

Each of the first sheet 521 to the third sheet 523 is a flexible member. The material (constituent) of the first sheet 521 to the third sheet 523 is, for example, polyethylene terephthalate (PET), nylon, or polyethylene. The first sheet 521 to the third sheet 523 may be configured to have layered structure by using a plurality of films made of these materials. In such a layered configuration, the outer layer may be formed with, for example, PET or nylon, which has excellent impact resistance, and the inner layer may be formed with polyethylene, which has excellent ink resistance. Furthermore, a film having a layer formed by deposition of aluminum may be included as a constituent member of the layered configuration. Such a configuration improves the gas-barrier properties, thereby suppressing the change in density of the ink stored in the liquid container part 52, for example. In this way, the material of the liquid container part 52 can be determined as needed.

Although the liquid container part 52 in this embodiment is of the type with the first sheet 521 to the third sheet 523 attached to each other by fusing or the like, the third sheet 523 may be omitted, and the liquid container part 52 may be of the type with the first sheet 521 and the second sheet 522 attached to each other by fusing or the like (so-called pillow type).

As shown in FIG. 11, the flow channel forming member 70 is disposed within the liquid container part 52. The flow channel forming member 70 is a tube. In other words, the flow channel forming member 70 is a member having a cylindrical shape. The flow channel forming member 70 is elastic. The flow channel forming member 70 is formed from, for example, elastomer, or rubber so as to be elastic. The flow channel forming member 70 forms a flow channel for bringing the inside of the liquid container part 52 and the liquid supply part 57 into communication. The ink in the liquid container part 52 passes through the flow channel in the flow channel forming member 70 and is thus supplied to the liquid supply part 57.

As shown in FIG. 13, the handle part 53 includes a grip part 54 located at the end portion in the +Z axis direction, the attaching part 549 located at the end portion in the −Z axis direction, and a base part 548 located between the grip part 54 and the attaching part 549 with respect to the Z axis direction. The handle part 53 further includes a first connection part 546 located at the end portion in the +K2 axis direction, and a second connection part 547 located at the end portion in the −K2 axis direction.

Each of the grip part 54, the first connection part 546, the second connection part 547, and the base part 548 has the shape of a rod. The grip part 54, the first connection part 546, the second connection part 547, and the base part 548 form a member having the shape of a frame. Thus, a receiving space 542 having a substantially rectangular shape for receiving a hand of the user is defined in the handle part 53.

The grip part 54 is the part at which the user grips the liquid container 50. The grip part 54 extends along the K2 axis direction.

The first connection part 546 is a member extending from one end portion of the grip part 54 in the K2 axis direction towards the base part 548 (toward the −Z axis direction, i.e., toward the liquid container part 52 shown in FIG. 11). The second connection part 547 is a member extending from the other end portion of the grip part 54 in the K2 axis direction toward the base part 548 (toward −Z axis direction, i.e., toward the liquid container part 52 shown in FIG. 7). The base part 548 opposes the grip part 54 with the receiving space 542 therebetween. The base part 548 extends along the K2 axis direction. To the base part 548, a positioning part 56, a circuit substrate holding part (a contact part positioning part) 59, and a pressing part 545, which will be described later, are attached.

The attaching part 549 extends along the K2 axis direction. The attaching part 549 is the part to which the one end portion 501 of the liquid container part 52 (FIG. 11) is attached by fusing or the like.

As shown in FIG. 13, the liquid supply unit 55 includes the liquid supply part 57 and the positioning part 56. Note that the positioning part 56 is configured as a part that is separated from the liquid supply part 57, and a small gap is formed between the positioning part 56 and the liquid supply part 57. The liquid supply unit 55 is formed so as to project outward (in the −K1 axis direction) from the handle part 53.

The liquid supply part 57 is in communication with the inside of the liquid container part 52, and supplies the ink in the liquid container part 52 to the printer 10. Specifically, the ink in the liquid container part 52 passes through the flow channel forming member 70 and the flow channel (not shown in the drawings) inside the handle part 53, and reaches the liquid supply part 57. The ink that has reached the liquid supply part 57 is then supplied to the recording head of the printer 10 via the flow channels 362, 365, and 72 in the attachment/detachment unit 30.

The liquid supply part 57 has a liquid supply opening 572 at one end and a supply connection part 573 at the other end. The liquid supply opening 572 is in communication with the inside of the liquid container part 52, and causes the ink stored in the liquid container part 52 to flow to the outside (printer 10). The liquid supply part 57 is a cylindrical member (annular member) extending along the K1 axis direction (the direction along a central shaft CT). The liquid supply part 57 is formed so as to project outward (in the −K1 axis direction) from the handle part 53.

The liquid supply part 57 has the central shaft CT. The central shaft CT is parallel with the K1 axis direction. Here, with respect to the K1 axis direction, the direction from the liquid supply opening 572 to the supply connection part 573 is defined as +K1 axis direction, and the direction from the supply connection part 573 to the liquid supply opening 572 is defined as −K1 axis direction. A valve mechanism for opening and closing the internal flow channel of the liquid supply part 57 is provided inside the liquid supply part 57. The valve mechanism opens the flow channel when the liquid introduction part 362 (FIG. 8) is inserted into the liquid supply part 57 so that the ink can be distributed from the liquid supply part 57 to the liquid introduction part 362.

As shown in FIG. 13, when the liquid container 50 is in unused state, the liquid supply opening 572 is covered with a film 99. The ink is thus prevented from flowing to the outside from the liquid supply opening 572 before the liquid container 50 is attached to the attachment/detachment unit 30 (FIG. 5). The film 99 gets ripped by the liquid introduction part 362 (FIG. 8) when the liquid container 50 is attached to the attachment/detachment unit 30.

As shown in FIG. 13, when the liquid container 50 is connected to the printer 10, the positioning part 56 roughly determines the position of the liquid container 50 including the liquid supply opening 572, with respect to the printer 10. The positioning part 56 is provided integrally with the handle part 53. In this embodiment, the positioning part 56 and the handle part 53 are formed by casting, and the positioning part 56 is thereby provided integrally with the handle part 53. Here, "provided integrally" means that the positioning part 56 is provided in the handle part 53 so as to move along with the movement of the handle part 53. In another embodiment, the positioning part 56 may be provided integrally with the handle part 53 by attaching the positioning part 56 to the handle part 53 by fusing or the like. Although the positioning part 56 is provided in the vicinity of the liquid supply opening 572 so as to surround the liquid supply opening 572 along the circumferential direction except for above the liquid supply opening 572, when the handle part 53 is made of a material that is not readily deformable, the positioning part 56 may be located at, of the handle part 53, a position that is more or less distant from the liquid supply opening 572. The positioning part 56 projects from the handle part 53 in the −K1 axis direction.

The positioning part 56 is located in the vicinity of the liquid supply opening 572. Also, at least a portion of the positioning part 56 is located on the liquid supply opening 572, on the side of the liquid container part 52 (in the −Z axis direction). In this embodiment, the positioning part 56 is located around the liquid supply part 57 with the central shaft CT at the center. Specifically, the positioning part 56 is located around the liquid supply part 57 except for a portion on the side of the grip part 54.

When the liquid container 50 is attached to the printer 10, the positioning part 56 roughly determines the position of the liquid container 50 by being brought into contact with the movable member 40 of the attachment/detachment unit 30 (FIG. 5) and thereby regulating the movement of the liquid supply part 57.

As shown in FIG. 13, the substrate unit 58 includes the circuit substrate 582 and the contact part positioning part 59. The substrate unit 58 is formed so as to project outward (in the −K1 axis direction) from the handle part 53. The projecting direction of the substrate unit 58 is the same as the projecting direction of the liquid supply part 57 (−K1 axis direction). Note that the projecting direction of the substrate unit 58 and the projecting direction of the liquid supply part 57 are not necessarily the same, and it is only required that they are substantially parallel with each other. The substrate unit 58 is arranged next to the liquid supply unit 55 along the K2 axis direction.

The contact part positioning part 59 positions the circuit substrate 582. The contact part positioning part 59 is provided integrally with the handle part 53. In this embodiment, the contact part positioning part 59 and the handle part 53 are formed by casting, and the contact part positioning part 59 is thereby provided integrally with the handle part 53. Here, "provided integrally" means that the contact part positioning part 59 is provided in the handle part 53 so as to move along with the movement of the handle part 53. In another embodiment, the contact part positioning part 59 may be provided integrally with the handle part 53 by attaching the contact part positioning part 59 to the handle part 53 by fusing or the like.

The contact part positioning part 59 has a concave shape with an opening provided on the +Z axis direction side (on the side of the grip part 54). A bottom part 594 of the concave shape is inclined with respect to the K1 axis direction. The circuit substrate 582 is attached to the bottom part 594, and accordingly the circuit substrate 582 is held in the state of being inclined with respect to the horizontal direction, by the contact part positioning part 59.

As shown in FIG. 14, a boss groove 584 is formed in an upper end portion 586 of the circuit substrate 582 in the +Z axis direction, and a boss hole 585 is formed in a lower end portion 587 of the circuit substrate 582 in the −Z axis direction. The circuit substrate 582 is fixed to the bottom part 594 (FIG. 13) by using the boss groove 584 and the boss hole 585.

As shown in FIG. 14 and FIG. 15, the circuit substrate 582 includes a liquid container-side terminals 580 provided on a front surface 582*fa* and a storage device 583 provided on a rear surface 582*fb*. The front surface 582*fa* and the rear surface 582*fb* are flat surfaces.

The liquid container-side terminals 580 include nine terminals 581A to 581I. The storage device 583 stores information about the liquid container 50 (e.g., the amount of remaining ink, the color of ink). The storage device 583 and the nine terminals 581A to 581I are electrically connected.

As shown in FIG. 14, each of the nine liquid container-side terminals 581A to 581I is formed to have a substantially rectangular shape. The nine liquid container-side terminals 581A to 581I are arranged so as to form two rows Ln1 and Ln2 that are separate from each other in the Z axis direction, which is the direction that intersects with the attaching direction (−K1 axis direction). The rows Ln1 and Ln2 are parallel with the K2 axis direction.

A contact part cp is formed in the central portion of each of the liquid container-side terminals 581A to 581I, which is brought into contact with the corresponding one of the apparatus-side terminals 381. The rows Ln1 and Ln2 may be considered as rows composed of a plurality of contact parts cp. Note that when the liquid container-side terminals 581A to 581I are referred to without being distinguished from each other, the sign "581" is used.

Figure 16:
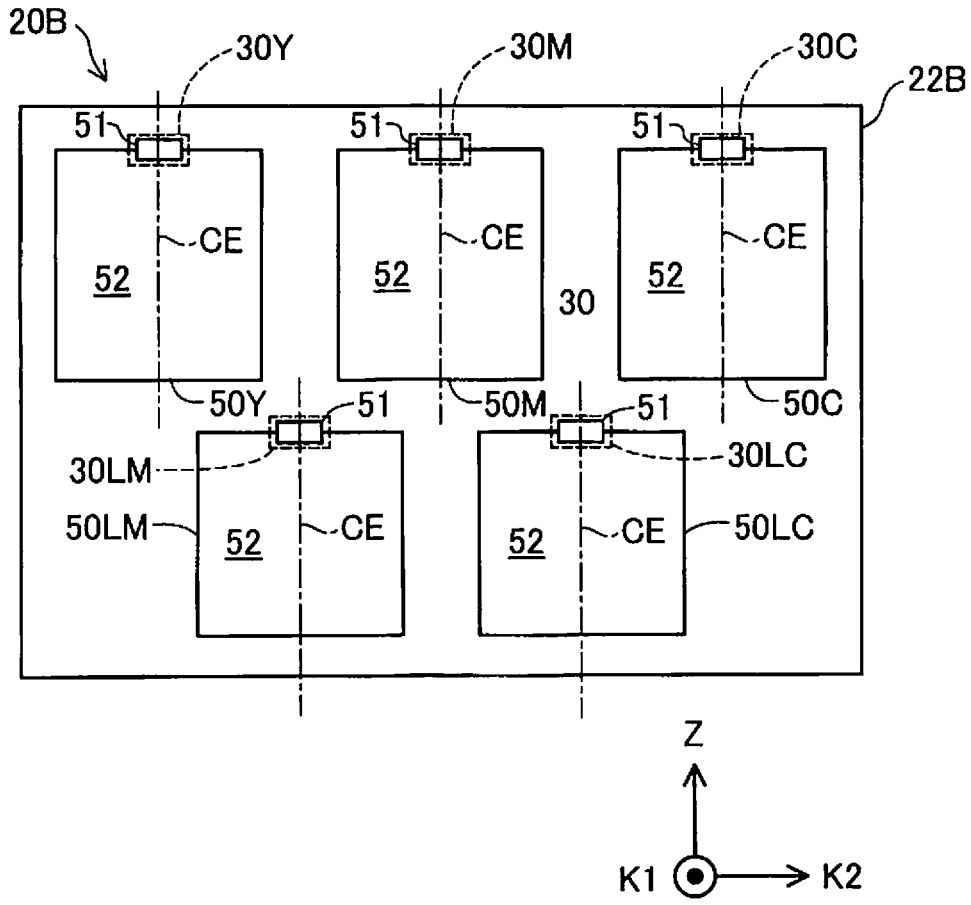
FIG. 16 is a diagram illustrating the position of the liquid container in the attached state.

A-4. Arrangement of Liquid Containers 50:

FIG. 16 is a diagram illustrating the arrangement of the liquid containers 50C, 50M, 50Y, 50LM, and 50LC in the attached state. FIG. 16 schematically shows the attachment/detachment units 30 and the liquid containers 50C, 50M, 50Y, 50LM, and 50LC, which are arranged inside the casing 22B. FIG. 16 is a view of the casing 22B seen from the +K1 axis direction.

The five liquid containers 50C, 50M, 50Y, 50LM, and 50LC are arranged so as to form two tiers one above the other. The upper tier is composed of three liquid containers 50C, 50M, 50Y. The three liquid containers 50C, 50M, and 50Y are arranged along the horizontal direction (K2 axis direction). Two liquid containers 50LC and 50LM are arranged below the three liquid containers 50C, 50M, and 50Y. The two liquid containers 50LC and 50LM are arranged along the horizontal direction. The three liquid container 50C, 50M and 50Y constituting the upper tier and the two liquid containers 50LC and 50LM constituting the lower tier are arranged at intervals so as not to overlap in the top-to-bottom direction. As described above, at least two liquid containers (e.g., the liquid container 50C and the liquid container 50LC) among the plurality of liquid containers 50C, 50M, 50Y, 50LC, and 50LM are arranged one above the other within the casing 22B.

The three liquid containers 50C, 50M and 50Y arranged in the upper tier and the two liquid containers 50LM and 50LC arranged in the lower tier are offset from each other in the direction that intersects with the top-to-bottom direction (the Z axis direction). In this embodiment, the direction that intersects with the top-to-bottom direction is the K2 axis direction. The reference positions for offsetting are central planes CE that each passes through the center in the width direction (the K2 axis direction, the direction that is orthogonal to the attaching direction and to the top-to-bottom direction) of the liquid container part 52 of the corresponding liquid container 50, and that each is parallel with the top-to-bottom direction. In other words, the respective central planes CE of the liquid container parts 52 of the liquid containers 50 arranged in multiple tiers (two tiers in this embodiment) in the top-to-bottom direction are offset from each other in the K2 axis direction. In this embodiment, the five liquid containers 50C, 50M, 50Y, 50LM, and 50LC are arranged in a staggered manner.

In this embodiment, it is preferable that the liquid containers 50 in the upper tier and the lower tier are offset in the direction (K2 axis direction) that intersects with the top-to-bottom direction such that the respective container part supporting assembly 51 (specifically, at least the liquid supply part 57 shown in FIG. 13) of each of the liquid containers 50LM and 50LC does not located right below any of the liquid containers 50C, 50M, and 50K in the upper tier. This configuration further improves the operability in attaching/detaching the liquid containers 50LC and 50LM in the lower tier to/from the attachment/detachment units 30. In other words, the configuration reduces the possibility that attaching/detaching of the liquid containers 50LM and 50LC in the lower tier to/from the attachment/detachment units 30 is disturbed by the liquid containers 50C, 50M and 50K in the upper tier.

The five attachment/detachment units 30C, 30M, 30Y, 30LC, and 30LM are arranged so as to correspond in arrangement position to the five liquid containers 50C, 50M, 50Y, 50LM, and 50LC. Specifically, three attachment/detachment units 30C, 30M, and 30Y are arranged in the upper tier, and two attachment/detachment units 30LC and 30LM are arranged below the three attachment/detachment units 30C, 30M, and 30Y. In other words, the plurality of liquid introduction parts 362 (FIG. 5) and the plurality of apparatus-side terminals 381 (FIG. 5) are arranged within the casing 22B so as to correspond in arrangement position to the plurality of liquid containers 50.

A-5. Advantageous Effects:

According to the above-described embodiment, as shown in FIG. 16, the plurality of liquid containers 50C, 50M, 50Y, 50K, 50LC, and 50LM are arranged within the casing 22B so as to form rows that are separate from each other in the top-to-bottom direction. Specifically, three liquid containers 50C, 50M, and 50Y are arranged in the upper tier, and two liquid containers 50LC and 50LM are arranged below the three liquid containers 50C, 50M, and 50Y. Here, as shown in FIG. 1 and FIG. 2, the printer 10 can be more easily increased in length in the height direction (the Z axis direction, the top-to-bottom direction) than in the depth direction (X axis direction) and in the width direction (Y axis direction). For example, it is easy to increase the height of the printer 10 by providing another paper feed cassette 16 or providing the printer 10 with a mount on which the printer body 19 is placed. Therefore, when arranging a plurality of liquid containers 50 within the casing 22B, the plurality of liquid containers 50 can be arranged by arranging a plurality of liquid containers 50 along the top-to-bottom direction, effectively using the space extending in the height direction of the printer 10.

By arranging a plurality of liquid containers 50 along the top-to-bottom direction, it is possible to suppress the increase in size of the liquid supply apparatus 20B in the directions (the depth direction and the width direction) that are perpendicular to the top-to-bottom direction. Such a configuration prevents the liquid supply apparatus 20B from projecting from the outer frame of a face (e.g. the right side face 106) constituting the outer shell of the printer 10, resulting in suppressing the increase in size of the liquid injection recording system 1000.

Also, in the above-described embodiment, as shown in FIG. 2, the casing 22B is located on the right side face 106 which is on the right side of the printer 10 when seen from the direction of the front face 102. This configuration improves the operability of the liquid supply apparatus 20B when operated from the side of the front face 102. For example, the user can easily open or close the casing 22B from the side of the front face 102 and attach or detach the liquid containers 50. Here, the casing 22B in which a plurality of liquid containers 50 are arranged along the top-to-bottom direction may be provided on the left side face 104, or on both the right side face 106 and the left side face 104. When the casing 22B is provided on the left side face 104, two liquid containers 50K may be arranged along the top-to-bottom direction, for example.

Also, in the above-described embodiment, as shown in FIG. 16, the five attachment/detachment units 30C, 30M, 30Y, 30LC, and 30LM are arranged so as to correspond in arrangement position to the five liquid containers 50C, 50M, 50Y, 50LM, and 50LC. This configuration makes it easy to attach the liquid containers 50 to the attachment/detachment units 30 with reference to the arrangement positions of the liquid introduction parts 362 of the attachment/detachment units 30 (FIG. 6) and the apparatus-side terminals 381 of the contact mechanism 38 (FIG. 6).

Also, in the above-described embodiment, as shown in FIG. 10A, the liquid containers 50 are arranged within the casing 22B by attaching the liquid containers 50 to the attachment/detachment units 30 such that the liquid supply parts 57 are located above the level of the liquid container parts 52. This configuration improves the visibility of the liquid supply parts 57 at the time of attaching the liquid containers 50 to the inside of the casing 22B. In other words, this configuration reduces the possibility that the liquid supply parts 57 are hidden from view by the liquid container parts 52 at the time of attaching the liquid supply parts 57 to the liquid introduction parts 362 of the attachment/detachment units 30, and accordingly the configuration makes it easy to connect the liquid supply parts 57 to the liquid introduction parts 362 while checking the positions of the liquid supply parts 57.

Also, in the above-described embodiment, as shown in FIG. 7 and FIG. 10A, the liquid containers 50 are attached to the attachment/detachment units 30 such that the contact parts cp are located above the level of the liquid container parts 52, and thus the liquid containers 50 are arranged within the casing 22B. This configuration improves the visibility of the contact parts cp when the liquid containers 50 are attached to the inside of the casing 22B. In other words, this configuration reduces the possibility that the contact parts cp are hidden from view by the liquid container parts 52 at the time of attaching the contact parts cp to the apparatus-side terminals 381 of the attachment/detachment units 30, and accordingly the configuration makes it easy to bring the contact parts cp into contact with the apparatus-side terminals 381 while checking the positions of the contact parts cp.

Also, in the above-described embodiment, as shown in FIG. 11 and FIG. 13, the handle part 53 and the liquid supply part 57 are arranged on the side of the one end portion 501 of the liquid container part 52. This configuration makes it easy to change the position of the liquid supply part 57 by gripping the handle part 53 and moving the liquid container 50.

Figure 17:
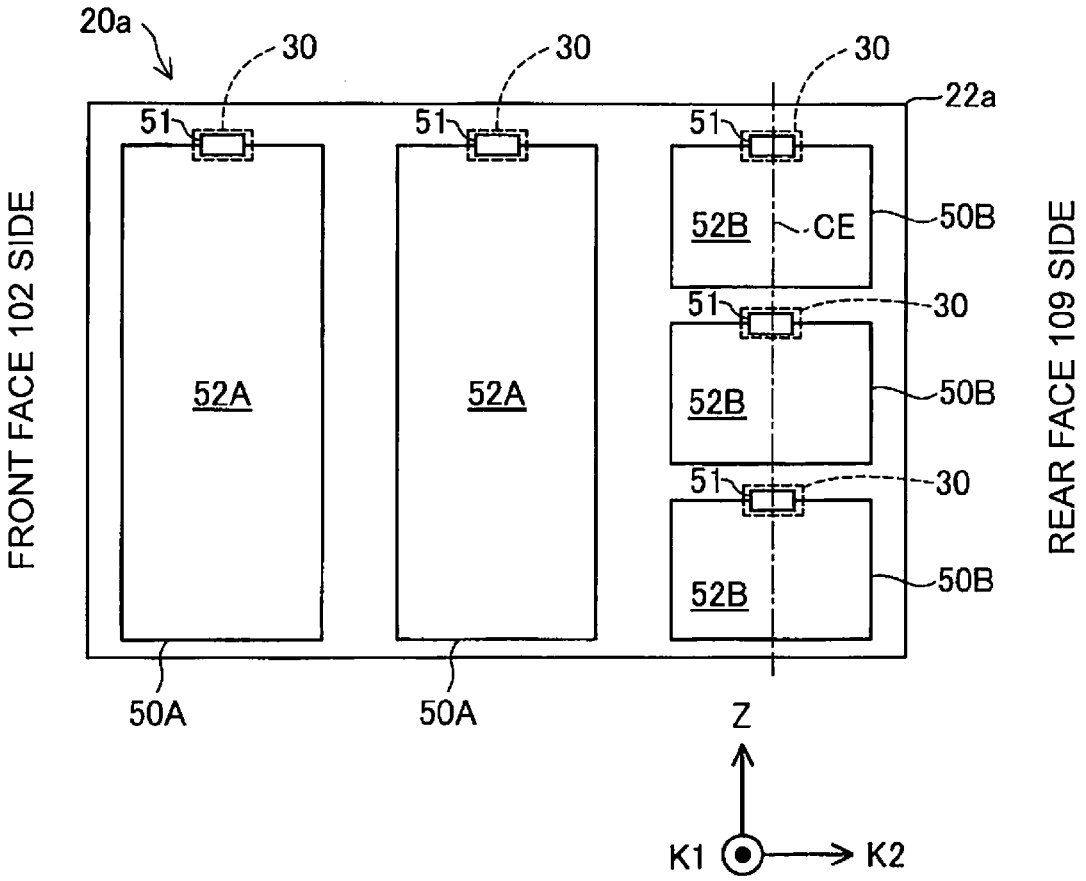
FIG. 17 is a diagram illustrating a liquid supply apparatus according to a second embodiment.

B. Second Embodiment:

FIG. 17 is a diagram illustrating a liquid supply apparatus 20*a* according to a second embodiment. FIG. 17 corresponds to FIG. 16, and shows a casing 22*a* seen from the +K1 axis direction. The liquid injection recording system 1000 may be provided with the liquid supply apparatus 20*a* according to the second embodiment, as a substitute to at least one of the liquid supply apparatuses 20A and 20B (FIG. 1 and FIG. 2) according to the first embodiment. The liquid supply apparatus 20*a* according to the second embodiment is different from the liquid supply apparatus 20B according to the first embodiment in the arrangement of the plurality of attachment/detachment units 30 and the arrangement of the plurality of liquid containers 50. Since the other elements are the same as the elements of the first embodiment, the same elements are given the same reference signs and the description thereof is omitted. When the plurality of liquid containers 50B are arranged along the top-to-bottom direction within the casing 22*a*, the following arrangement method may be adopted instead of the method adopted in the above-described first embodiment.

In the initial state before the ink is consumed, the liquid supply apparatus 20*a* includes first-type liquid containers 50A that each store a first amount of ink and a second-type liquid containers 50B that each store a second amount of ink, where the second amount is smaller than the first amount. In other words, the liquid container part 52A of each first-type liquid container 50A has a larger capacity than the liquid container part 523 of each second-type liquid container 50B. In the second embodiment, two first-type liquid containers 50A and three second-type liquid containers 50B are provided. The types (e.g. the colors) of the ink stored in the first-type liquid containers 50A and the second-type liquid containers 50B are determined as needed. For example, the liquid container parts 52A of the two first-type liquid containers 50A may store black (K) ink, and the liquid container parts 52B of the three second-type liquid containers 50B may store yellow (Y), magenta (M), and cyan (C) ink, one color for each. As with the liquid containers 50 in the first embodiment, each of the first-type liquid containers 50A and the second-type liquid containers 50B is provided with the container part supporting assembly 51.

The liquid container part 52A of each first liquid container 50A has a greater length in the top-to-bottom direction (Z axis direction) than the liquid container part 52B of each second-type liquid container 50B. The longitudinal direction of the first-type liquid containers 50A coincides with the top-to-bottom direction. The two liquid containers 50A are arranged along the direction that intersect with the longitudinal direction (the K2 axis direction, the transverse direction).

The three liquid containers 50B are arranged along the direction that is parallel with the top-to-bottom direction (the longitudinal direction, the Z axis direction). At least part of each of the three liquid containers 50B, when seen from the direction (+K2 axis direction) that is orthogonal to the longitudinal direction (Z axis direction), overlaps any of the first-type liquid containers 50A. Also, the three second-type liquid containers 50B are arranged such that their respective central planes CE coincide. In other words, the three liquid containers 50B are arranged without being offset in the direction (e.g. the K2 axis direction) that intersects with the top-to-bottom direction. Note that each of the three liquid containers 50B arranged in multiple tiers along the top-to-bottom direction may be offset in the K2 axis direction. Also, the first-type liquid containers 50A are located closer to the front face 102 than the second-type liquid containers 50B are.

The casing 22*a* is provided with the attachment/detachment units 30 that correspond in arrangement position to the five liquid containers, 50A and 50B.

Figure 18:
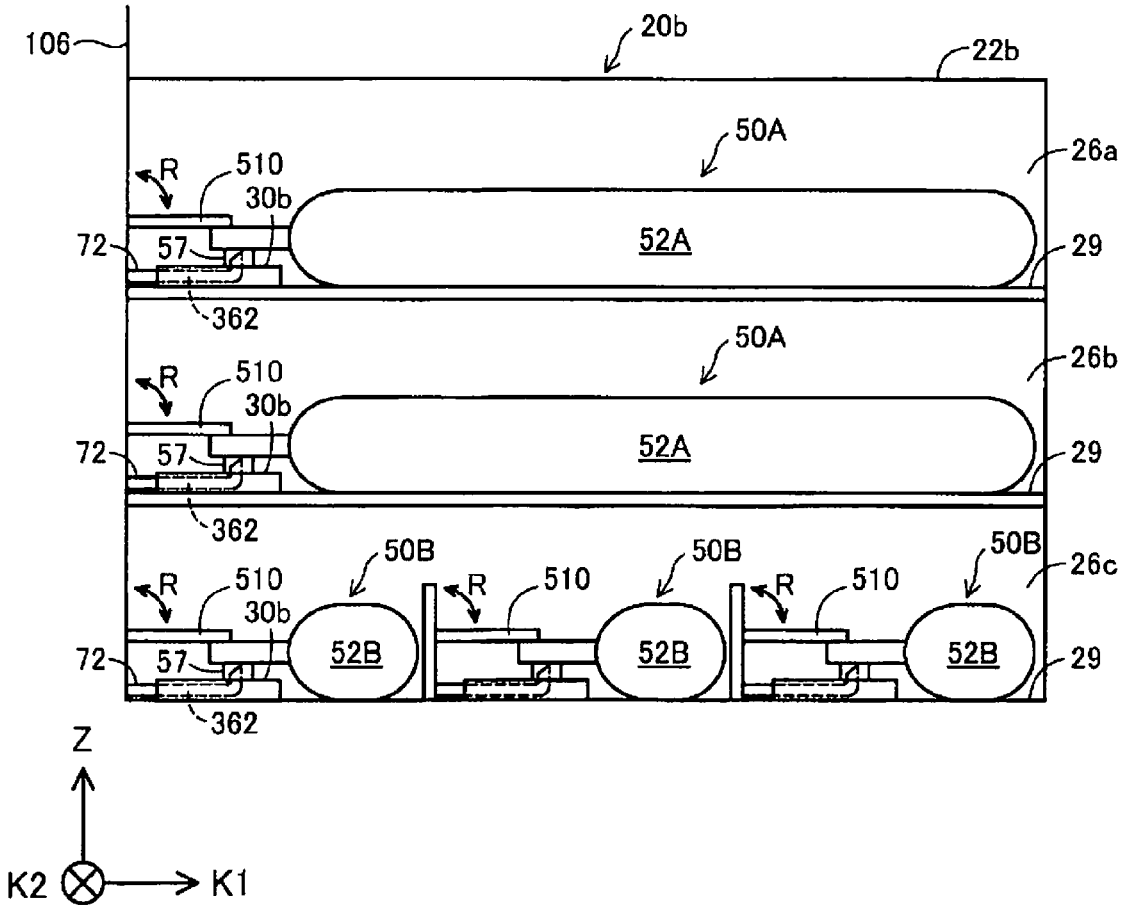
FIG. 18 is a diagram illustrating a liquid supply apparatus according to a third embodiment.

C. Third Embodiment:

FIG. 18 is a diagram illustrating a liquid supply apparatus 20*b* according to a third embodiment. FIG. 18 is a view of the casing 22*b* seen from the −K2 axis direction. The liquid injection recording system 1000 may be provided with the liquid supply apparatus 20*b* according to the third embodiment, as a substitute to at least one of the liquid supply apparatuses 20A and 20B (FIG. 1 and FIG. 2) according to the first embodiment. The liquid supply apparatus 20*b* according to the third embodiment is different from the liquid supply apparatus 20B (FIG. 2) according to the first embodiment in the configuration of the casing 22*b* and the configurations of the attachment/detachment units 30*b*. Since the other elements are the same as the elements of the first embodiment, the same elements are given the same reference signs and the description thereof is omitted. When the plurality of liquid containers 50A and 50B are arranged along the top-to-bottom direction within the casing 22*b*, the following arrangement method may be adopted instead of the method adopted in the above-described first embodiment.

The casing 22*b* includes three container space parts 26*a*, 26*b*, and 26*c*. The three container space parts 26*a*, 26*b*, and 26*c* are stacked in the top-to-bottom direction. The container space parts 26*a*, 26*b*, and 26*c* are arranged from top to bottom in this order.

Each of the container space parts 26*a*, 26*b*, and 26*c* has a mount 29. The mounts 29 are for arranging the liquid containers 50A and 50B. The wall of the casing 22*b* on the side of the +K1 axis direction is configured to be openable/closable, and each mount 29 is configured to be slidable in the K1 axis direction. When the liquid containers 50A and 50B are attached/detached to/from the casing 22*b*, the mount 29 is moved toward the +K1 axis direction. As a result, part of the mount 29 will be located outside the casing 22*b*, and the user can attach/detach the liquid containers 50A and 50B to/from the attachment/detachment units 30*b*. In this embodiment the attaching direction of the liquid containers 50A and 50B coincides with the −Z axis direction.

An attachment/detachment unit 30*b* is attached to each mount 29. The attachment/detachment unit 30*b* has the configuration of the attachment/detachment unit 30 (FIG. 6) of the first embodiment from which the movable member 40 is omitted. Note that the configuration of the attachment/detachment unit 30*b* is not limited to the above, and it is only required to be provided with the liquid introduction part 362, the flow passage member 72, and the apparatus-side electrical connection parts 381. The attachment/detachment unit 30*b* also has a lever member 510. The lever member 510 is attached to the casing 22*b*. The lever member 510 is rotatable in the direction indicated by the arrow R about the pivot at one end portion, and fixes the liquid container 50 by lowering the other end portion. This configuration maintains the connection between the liquid introduction part 362 and the liquid supply part 57 and the contact between the apparatus-side terminals 381 and the contact parts cp in a preferable state. When detaching the liquid container 50A or 50B from the attachment/detachment unit 30*b*, first, the other end portion of the lever member 510 is lifted up, and then the liquid container 50A or 50B is detached from the attachment/detachment unit 30*b*.

The set of three second-type liquid containers 50B and the two first-type liquid containers 50A are arranged in the top-to-bottom direction. The three second-type liquid containers 50B are arranged along the direction that is parallel with the longitudinal direction (the K1 axis direction) of the first-type liquid containers 50A. Also, at least part of each of the three liquid containers 50B, when seen from the direction (−Z axis direction) that is orthogonal to the longitudinal direction (K1 axis direction), overlaps the adjacent first-type liquid container 50A.

In the above-described second and third embodiments, as shown in FIG. 17 and FIG. 18, a plurality of second-type liquid containers 50B are arranged along the direction that is parallel with the longitudinal direction of the first-type liquid containers 50A. Also, at least part of each of the three liquid containers 50B, when seen from the direction (+K2 axis direction) that is orthogonal to the longitudinal direction (Z axis direction), overlaps the first-type liquid containers 50A. Therefore, the first-type liquid containers 50A and the second-type liquid containers 50B, each having a different capacity, can be arranged by effectively using the space within the casings 22*a* and 22*b*.

Furthermore, in the above-described second embodiment, as shown in FIG. 17, the first-type liquid containers 50A having a large capacity are located closer to the front face 102 than the second-type liquid containers 50B having a small capacity are. This configuration makes it easy to attach/detach the first-type liquid container 50A from the side of the front face 102 of the casing 22*a*.

Figure 19:
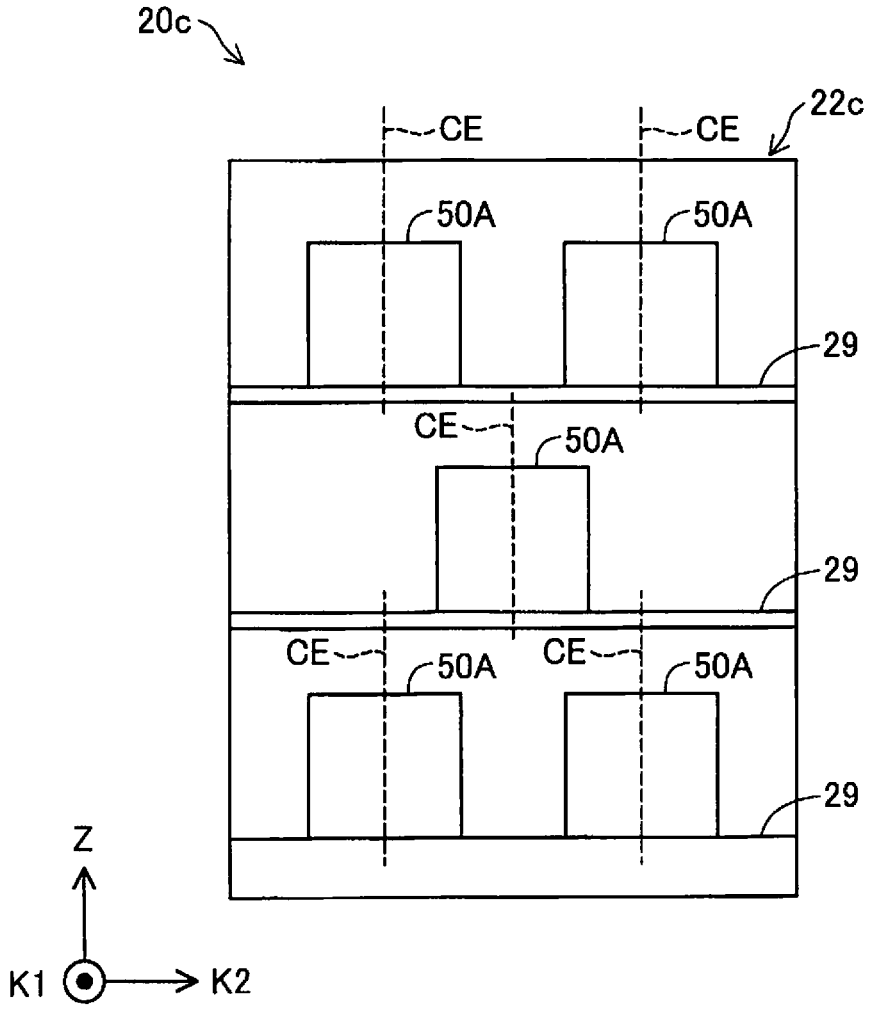
FIG. 19 is a first diagram illustrating a liquid supply apparatus according to a fourth embodiment.
Figure 20:
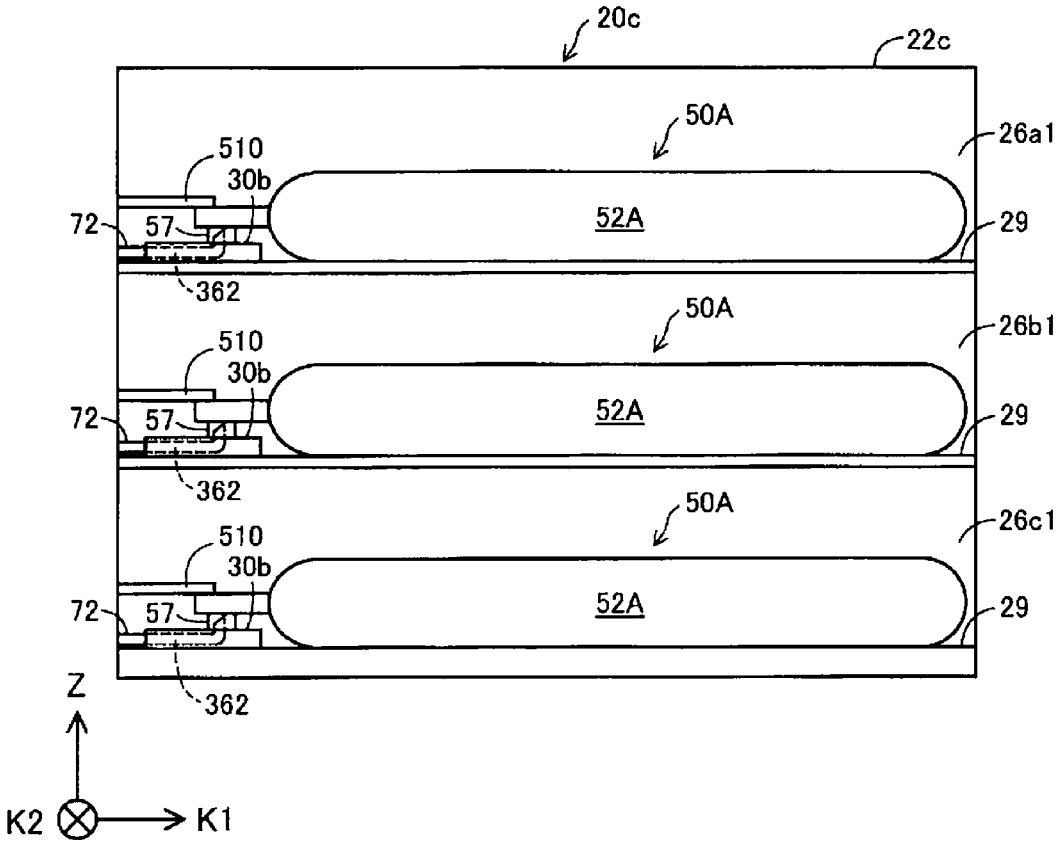
FIG. 20 is a second diagram illustrating a liquid supply apparatus according to the fourth embodiment.

D. Fourth Embodiment:

FIG. 19 is a first diagram illustrating a liquid supply apparatus 20*c* according to a fourth embodiment. FIG. 20 is a second diagram illustrating the liquid supply apparatus 20*c* according to the fourth embodiment. The liquid supply apparatus 20*c* according to the fourth embodiment is different from the liquid supply apparatus 20*b* (FIG. 18) according to the third embodiment in mainly the arrangement of the first-type liquid containers 50A. The same elements as in the third embodiment are given the same reference signs and the description thereof is omitted.

The casing 22*c* includes three container space parts 26*a*1, 26*b*1, and 26*c*1. The three container space parts 26*a*1, 26*b*1, and 26*c*1 are stacked in the top-to-bottom direction. The container space parts 26*a*1, 26*b*1, and 26*c*1 are arranged from top to bottom in this order.

Each of the container space parts 26*a*1, 26*b*1, and 26*c*1 has a mount 29. The mounts 29 are for arranging the first-type liquid containers 50A. In this embodiment, in the container space part 26*a*1 in the uppermost tier, two first-type liquid containers 50A are arranged next to each other along the K2 axis direction. In the container space part 26*b*1 in the middle tier, one first-type liquid container 50A is arranged. In the container space part 26*c*1 in the lowermost tier, two first-type liquid containers 50A are arranged next to each other along the K2 axis direction.

The first-type liquid containers 50A adjacent in the top-to-bottom direction are each offset in the direction (the horizontal direction, the K2 axis direction) that intersects with the top-to-bottom direction. For example, the two first-type liquid containers 50A arranged in the container space part 26*a*1 in the uppermost tier and the one first-type liquid container 50A arranged in the container space part 26*b*1 in the middle tier are offset in the K2 axis direction so as not to be aligned. Also, the one first-type liquid container 50A arranged in the container space part 26*b*1 in the middle tier and the two first-type liquid containers 50A arranged in the container space part 26*c*1 in the lowermost tier are offset in the K2 axis direction so as not to be aligned.

As shown in FIG. 20, each of the container space parts 26*a*1, 26*b*1, and 26*c*1 is provided with the attachment/detachment unit 30*b* for detachably attaching the first-type liquid container 50A, as with the container space parts 26*a*, 26*b*, and 26*c* (FIG. 18) of the third embodiment.

The above-described embodiment achieves the same advantageous effects as other embodiments, resulting from the same configuration. For example, the plurality of liquid containers 50A are arranged along the top-to-bottom direction within the casing 22*c*. Therefore, the plurality of liquid containers 50 can be arranged, effectively using the space extending in the height direction of the printer 10. Also, the first-type liquid containers 50A adjacent in the top-to-bottom direction are each offset in the direction that intersects with the top-to-bottom direction. This configuration further improves the operability in attaching/detaching the first-type liquid containers 50A in the lower tier to/from the attachment/detachment units 30. In other words, the configuration reduces the possibility that attaching/detaching of the first-type liquid containers 50A in the lower tier to/from the attachment/detachment units 30 is disturbed by the first-type liquid containers 50A in the upper tier.

Figure 21:
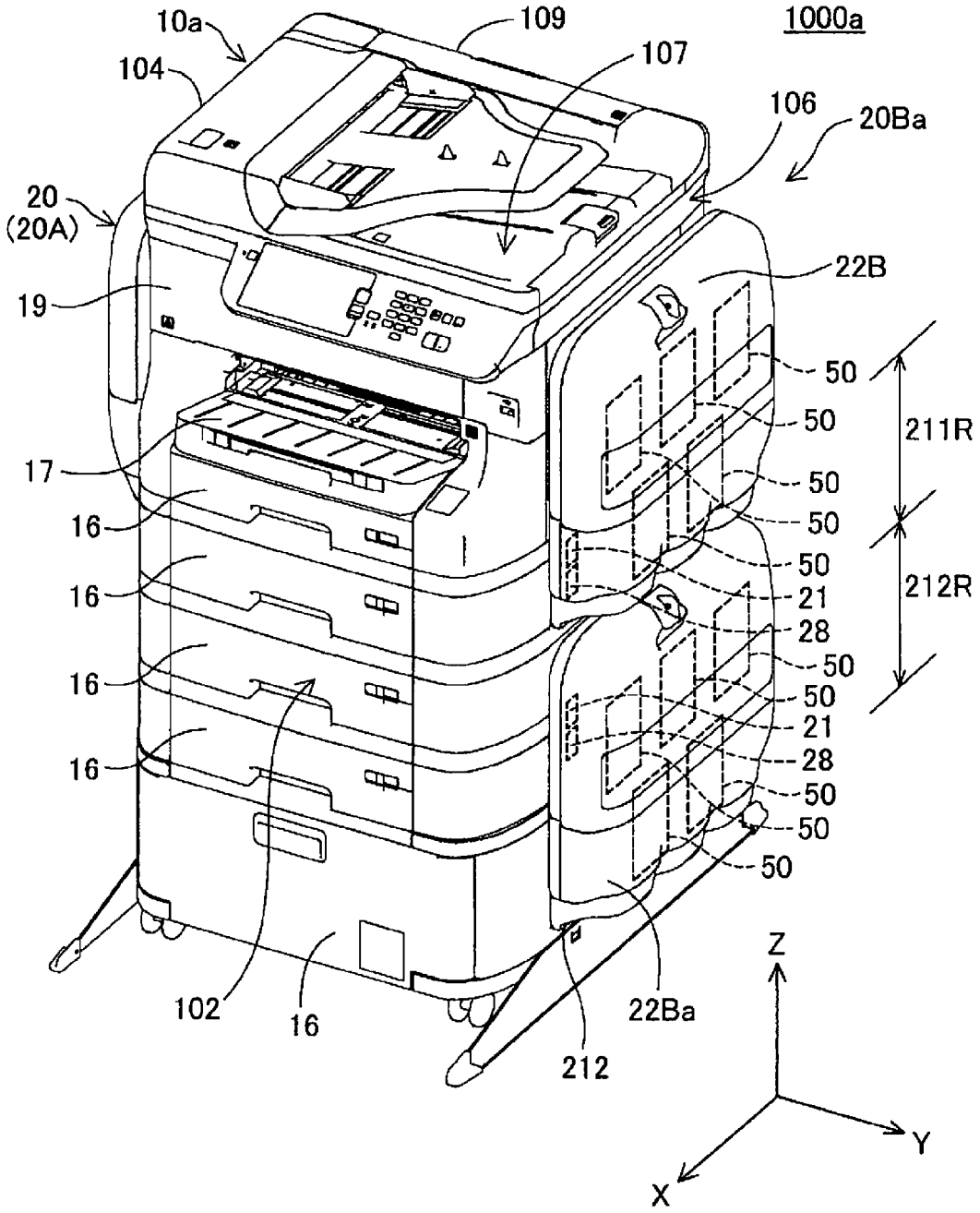
FIG. 21 is a perspective view of a liquid ejection recording system according to a fifth embodiment.

E. Fifth Embodiment:

FIG. 21 is a perspective view of a liquid injection recording system 1000*a* according to a fifth embodiment. The liquid injection recording system 1000*a* according to the fifth embodiment is different from the liquid injection recording system 1000 (FIG. 1) according to the first embodiment in the number of the paper feed cassettes 16 and the configuration of a second liquid supply apparatus 20Ba. Since the other elements of the fifth embodiment are the same as the elements of the first embodiment, the same elements are given the same reference signs and the description thereof is omitted.

Five layers of paper feed cassettes 16 are provided. Therefore, the liquid injection recording system 1000*a* according to the fifth embodiment has a greater length in the top-to-bottom direction (Z axis direction) than the liquid injection recording system 1000 according to the first embodiment.

The right side face 106 of the printer 10*a* is provided with a second liquid supply apparatus 20Ba. The second liquid supply apparatus 20Ba has an upper casing 22B and a lower casing 22Ba. The upper casing 22B and the lower casing 22Ba are supported on the right side face 106 by a supporting member such as a screw. Specifically, the upper casing 22B is supported on the printer body 19 by a supporting member such as a screw, and the lower casing 22Ba is supported on the paper feed cassettes 16 by a supporting member such as a screw. The upper casing 22B and the lower casing 22Ba are arranged in the top-to-bottom direction.

The upper casing 22B has the same configuration as the casing 22B according to the first embodiment. The lower casing 22Ba is different from the upper casing 22B in that the member relay part 21 and the wiring relay part 28 are located in the upper end portion 211R. The lower casing 22Ba is located right below the upper casing 22B. Note that the number of the paper feed cassettes 16 may be increased, and at least one of the upper casing 22B and the lower casing 22Ba may be additionally located below the lower casing 22Ba in the present arrangement.

In the above-described fifth embodiment, two casings 22B and 22Ba are arranged on the right side face 106, which is one wall surface of the printer 10*a*. Therefore, it is possible to provide the liquid supply apparatus 20Ba with a plurality of casings 22B and 22Ba while suppressing the increase in size in the direction that is orthogonal to the top-to-bottom direction. Also, as shown in FIG. 21, the printer 10*a* can be more easily increased in length in the height direction (the Z axis direction, the top-to-bottom direction) than in the depth direction (the X axis direction) and in the width direction (the Y axis direction). For example, it is easy to increase the height of the printer 10*a* by providing another paper feed cassette 16 or providing the printer 10*a* with a mount on which the printer body 19 is placed. Therefore, when the liquid supply apparatus 20Ba is provided with a plurality of casings 22B and 22Ba, the plurality of casings 22B and 22Ba can be arranged by arranging the plurality of casings 22B and 22Ba along the top-to-bottom direction, effectively using the space extending in the height direction of the printer 10*a*.

Also, in the above-described fifth embodiment, the casing 22Ba is supported on the paper feed cassette 16. Therefore, another casing 22Ba can be easily added by adding another paper feed cassette. This configuration is readily adaptable to design changes, for example in the case of increasing the number of ink types or the number of the liquid containers 50.

Also, in the above-described fifth embodiment, as in the first embodiment, the casings 22B and 22Ba have the flow passage member 72 (FIG. 8), which is flexible. Accordingly, even when the casings 22B and 22Ba are arranged along the top-to-bottom direction, the respective flow passage members 72 of the casings 22B and 22Ba improve the flexibility in designing of the flow passages from the liquid containers 50 to the recording head. For example, the flow passages can be adjusted by adjusting the directions in which the respective flow passage members 72 of the two casings 22B and 22Ba arranged along the top-to-bottom direction extend. Specifically, the flow passage member 72 of the upper casing 22B can be easily passed through the member relay part 21 of the upper casing 22B, and the flow passage member 72 of the lower casing 22Ba can be easily passed through the member relay part 21 of the lower casing 22Ba.

Also, the possibility that the lengths of the ink channels from the liquid containers 50 to the recording head become nonuniform can be reduced by adjusting, for example, the direction in which the flow passage member 72 of the upper casing 22B extends and the direction in which the flow passage member 72 of the lower casing 22Ba extends. In the fifth embodiment, the recording head is located at the same height as the upper casing 22B. Here, the flow passage member 72 of the upper casing 22B is passed through the member relay part 21 provided at the lower end portion 212R of the upper casing 22B, and the flow passage member 72 of the lower casing 22Ba is passed through the member relay part 21 provided at the upper end portion 211R of the lower casing 22Ba. This configuration reduces the possibility that the length of the channel from the liquid container 50 in the upper casing 22B to the recording head and the length of the channel from the liquid container 50 in the lower casing 22Ba to the recording head become extremely unbalanced. Accordingly, ink can be smoothly provided from each liquid container 50 to the recording head.

Also, with the member relay parts 21, the flow passage members 72 can be easily guided to the outside of the casings 22B and 22Ba. In particular, when each of the casings 22B and 22Ba has a plurality of flow passage members 72, the plurality of flow passage member 72 can be centralized to one location by the member relay parts 21, which make it easy to handle the plurality of flow passage members 72.

Also, in the fifth embodiment, as in the first embodiment, the casings 22B and 22Ba have the wires 603 (FIG. 10B). Accordingly, even when the casings 22B and 22Ba are arranged along the top-to-bottom direction, the respective electric wires 603 of the casings 22B and 22Ba improve the flexibility in designing of the electrical channels from the liquid containers 50 to the control part 12 (FIG. 1) of the printer 10*a*. For example, the electrical channels can be adjusted by adjusting the directions in which the respective electric wires 603 of the two casings 22B and 22Ba arranged along the top-to-bottom direction extend. Specifically, the wire 603 of the upper casing 22B can be easily passed through the wiring relay part 28 of the upper casing 22B, and the wire 603 of the lower casing 22Ba can be easily passed through the wiring relay part 28 of the lower casing 22Ba. Also, the possibility that the lengths of the respective electric wires 603 of the upper casing 22B and the lower casing 22Ba become nonuniform can be reduced by, for example, adjusting the direction in which the wire 603 of the upper casing 22B extends and the direction in which the wire 603 of the lower casing 22Ba extends. In the fifth embodiment, the control part 12 is located at the same height as the upper casing 22B. Here, the wire 603 of the upper casing 22B is passed through the wiring relay part 28 provided at the lower end portion 212R of the upper casing 22B, and the wire 603 of the lower casing 22Ba is passed through the wiring relay part 28 provided at the upper end portion 211R of the lower casing 22Ba. This configuration reduces the possibility that the length of the wire 603 of the upper casing 22B and the length of the wire 603 of the lower casing 22Ba become extremely unbalanced. This configuration reduces the possibility that the resistance of the electrical channel of the upper casing 22B and the resistance of the electrical channel of the lower casing 22Ba become extremely different.

Also, with the wiring relay parts 28, the wires 603 can be easily guided to the outside of the casings 22B and 22Ba. In particular, when each of the casings 22B and 22Ba has a plurality of wires 603, the plurality of wires 603 can be centralized to one location by the wiring relay parts 28, which make it easy to handle the plurality of wires 603.

F. Modified Examples:

Note that the invention is not limited to the above-described implementation examples or embodiments, and may be carried out in various other ways without departing from the spirit of the invention, and the following modifications are also possible.

F-1. First Modified Example:

In the first to fourth embodiment, the second liquid supply apparatus 20B is supported at the right side face 106 of the printer 10 (e.g. FIG. 2). However, it may be supported at another wall surface of the printer 10. For example, the second liquid supply apparatus 20B may be supported at the left side face 104 or the rear face 109 of the printer 10. Also, the casing 22B may be provided in a plurality, and each of the casings 22B may be supported at a different one of the wall surfaces 104, 106, and 109. With this configuration, the plurality of casings 22B can be arranged by using the plurality of wall surfaces 104, 106, and 109 of the printer 10.

Also, although the second liquid supply apparatus 20Ba of the fifth embodiment is supported at the right side face 106 (FIG. 21), it may be supported at another wall surface, 104 or 109. Also, the second liquid supply apparatus 20Ba may be provided in a plurality, and each of the plurality of second liquid supply apparatuses 20Ba may be provided on a different one of the wall surfaces 104, 106, and 109. With this configuration, the plurality of second liquid supply apparatuses 20Ba can be arranged by using the plurality of wall surfaces 104, 106, and 109 of the printer 10*a*.

F-2. Second Modified Example:

The liquid container 50 (FIG. 11) is not limited to the above-described embodiments, and only needs to be provided with a liquid container part for storing a liquid and a liquid supply part for supplying a liquid to the liquid ejection recording apparatus. In other words, the liquid container 50 does not necessarily have the handle part 53 or the circuit substrate 582. When the circuit substrate 582 is not provided, the contact mechanism 38 of the attachment/detachment unit 30 may be omitted. Also, although the liquid container part 52 in the above-described embodiments is flexible, it is not necessarily flexible. For example, the liquid container part 52 may be formed from a rigid member (e.g., polyethylene or polypropylene). Also, the liquid container part 52 may be housed in a casing or the like.

F-3. Third Modified Example:

In the above-described second embodiment, the first-type liquid containers 50A having a large capacity are located closer to the front face 102 than the second-type liquid containers 50B having a small capacity are (FIG. 17). This configuration may be applied to other embodiments as well. In other words, liquid containers 50 having a larger capacity may be located closer to the front face 102.

Also, liquid containers 50 that are used more frequently may be located closer to the front face 102 than liquid containers 50 that are used less frequently are. With this configuration, liquid containers 50 that are used frequently and require replacement frequently can be easily attached to/detached from the inside of the casing 22 from the side of the front face 102. An example of the liquid containers 50 that are used frequently is the liquid container 50K that stores a black ink when a plurality of liquid containers 50 each having a same capacity but each storing an ink of a different color are arranged.

F-4. Fourth Modified Example:

In the above-described embodiments, the contact parts cp serving as the container-side electrical connection part are located on the circuit substrate 582 (FIG. 14). However, the invention is not limited to this configuration, and the contact parts cp only need to be provided on the liquid container 50 such that they are electrically contactable with the apparatus-side terminals 381. Also, the container-side electrical connection part 582 may have a contact part for a terminal used for detecting the attachment/detachment of the liquid container 50. Also, the container-side electrical connection parts cp may be arranged on a circuit substrate that includes a flexible cable, such as a flexible printed circuit (FPC) substrate. This circuit substrate has a contact part that is contactable with the apparatus-side terminals 381 at one end. The other end is connected to a resetting apparatus, for example. The above-described modified example may be adopted instead of the circuit substrate 582, or adopted together with the circuit substrate 582.

Also, the circuit substrate 582 may be formed by using a bendable (flexible) film. Also, the contact parts cp only need to be arranged so as to be contactable with the apparatus-side terminals 381, and, for example, the surface 582*fa* (FIG. 15) on which the contact parts cp are arranged may be a curved surface or have steps.

F-5. Fifth Modified Example:

The invention is not limited to inkjet printers and liquid containers 50 thereof, and is also applicable to a liquid supply apparatus in which a given liquid ejection recording apparatus that ejects a liquid other than ink and liquid containers that store such a liquid are arranged therein. For example, the invention is applicable to the following various types of liquid ejection recording apparatuses and liquid supply apparatuses. Also, the liquid supply apparatuses in the embodiments are applicable to various types of liquid ejection apparatuses shown below that eject liquid to a medium, instead of to a liquid ejection recording apparatus that records images or the likes by ejecting liquid to a recording medium.

(1) Image recording apparatus such as a facsimile apparatus (2) Color material ejection recording apparatus used in the manufacture of a color filter for use in an image display device such as a liquid crystal display (3) Electrode material ejection apparatus used in electrode formation for an organic electroluminescence (EL) display, a field emission display (FED), or the like (4) Liquid ejection apparatus for ejecting a liquid that contains bioorganic material used in biochip manufacture (5) Specimen ejection apparatus for use as a precise pipette (6) Lubricating oil ejection apparatus (7) Resin liquid ejection apparatus (8) Liquid ejection apparatus for the pinpoint ejection of lubricating oil in a precision machine such as a clock or camera (9) Liquid ejection apparatus for ejecting a transparent resin liquid such as an ultraviolet curable resin liquid on a substrate in order to form, for example, microscopic semi-spherical lenses (optical lenses) for use in an optical communication element or the like

(10) Liquid ejection apparatus for ejecting an acidic or alkaline etching liquid for etching a substrate or the like

(11) Liquid ejection apparatus that includes a liquid ejection head for discharging any other microscopic droplets Note that "droplet" refers to the state of a liquid discharged from a liquid ejection recording apparatus or a liquid ejection apparatus, and encompasses granular, tear-drop, and trailing string-shaped droplets. Also, the "liquid" referred to here need only be a material that can be ejected from the liquid ejection recording apparatus or the liquid ejection apparatus. For example, the "liquid" need only be a material whose substance is in the liquid phase, and the "liquid" here encompasses high or low viscosity liquid materials, as well as liquid materials such as sols, gel water, other inorganic solvents, organic solvents, solutions, liquid resins, and liquid metals (metal melts). Also, the liquid is not limited to being a liquid as one state of materials, and the "liquid" here encompasses a substance in which functional material particles made of a solid substance such as pigment or metal particles are dissolved, dispersed, or mixed in a solvent. Other representative examples of liquids include liquid crystal and ink such as that described in the above embodiments. Here, "ink" encompasses general water-based ink and oil-based ink, as well as various types of liquid compositions such as gel ink and hot-melt ink. Also, when UV ink that can be cured by ultraviolet irradiation is stored in the liquid container part connected to the printer, the liquid container bags float above the mounting surface, and the possibility that the heat of the mounting surface is conducted to the liquid container part and cures the UV ink is reduced.

What is claimed is:

1. A liquid supply apparatus that is capable of supplying a liquid to a recording head of a liquid ejection recording apparatus, comprising:

a plurality of liquid containers, each including a liquid container part that is capable of storing the liquid, and a liquid supply part that is in liquid communication with the interior of the liquid container part and that is capable of supplying the liquid in the liquid container part to the liquid ejection recording apparatus; and a casing that detachably houses therein the plurality of liquid containers and that is supported by the liquid ejection recording apparatus, wherein at least two of the plurality of liquid containers are arranged along a top-to-bottom direction within the casing, each of the plurality of liquid containers further includes a container-side electrical connection part, the liquid supply apparatus further comprises an apparatus-side electrical connection part that is capable of establishing electrical connection by contacting with the container-side electrical connection part, the apparatus-side electrical connection part is provided in a plurality within the casing, in correspondence with the plurality of liquid containers, and the plurality of apparatus-side electrical connection parts are arranged so as to correspond in arrangement position to the plurality of liquid containers.

2. The liquid supply apparatus according to claim 1, wherein, among the at least two of the plurality of liquid containers arranged in the top-to-bottom direction, liquid containers that are adjacent in the top-to-bottom direction are each offset in a direction that intersects with the top-to-bottom direction.

3. The liquid supply apparatus according to claim 1, wherein the plurality of liquid containers include a first-type liquid container that stores a first amount of the liquid and a plurality of second-type liquid containers that each store a second amount of the liquid, the second amount being smaller than the first amount, the plurality of second-type liquid containers are arranged along a direction that is parallel with a longitudinal direction of the first-type liquid container, and at least part of each of the plurality of second-type liquid containers, when seen from a direction that is orthogonal to the longitudinal direction, overlaps the first-type liquid container.

4. The liquid supply apparatus according to claim 1, wherein a front face of the liquid ejection recording apparatus is provided with a recording medium outlet for discharging a recording medium, and the casing is located on at least one of right and left wall surfaces of the liquid ejection recording apparatus when the liquid ejection recording apparatus is seen from the front face.

5. The liquid supply apparatus according to claim 4, wherein the plurality of liquid containers include a first-type liquid container that stores a first amount of the liquid and a second-type liquid container that stores a second amount of the liquid, the second amount being smaller than the first amount, and the first-type liquid container is located closer to the front face than the second-type liquid container is.

6. The liquid supply apparatus according to claim 1, further comprising a liquid introduction part that is connected to the liquid supply part and that distributes the liquid introduced from the liquid supply part to the liquid ejection recording apparatus, wherein the liquid introduction part is provided in a plurality within the casing, in correspondence with the plurality of liquid containers, and the plurality of liquid introduction parts are arranged so as to correspond in arrangement position to the plurality of liquid containers.

7. The liquid supply apparatus according to claim 1, wherein each of the plurality of liquid containers is provided within the casing such that the container-side electrical connection part is located above a level of the liquid container part.

8. The method for manufacturing the target recording medium according to claim 1, wherein in the punching out of the target recording medium, the target recording medium is punched out by positionally aligning another blade which configures the punching die so that an overall shape of the traget recording medium forms a rectangle, and one side edge and the other side edge in the first direction or the second direction are formed with an asymmetric shape.

9. The liquid supply apparatus according to claim 1, wherein each of the plurality of liquid containers further includes a handle part that is grippable, and the handle part and the liquid supply part are arranged on one end portion of the corresponding liquid container part.

10. The liquid supply apparatus according to claim 1, wherein the casing is provided in a plurality, and each of the plurality of casings is supported at a different one of wall surfaces of the liquid ejection recording apparatus.

11. The liquid supply apparatus according to claim 1, wherein the casing is provided in a plurality, and the plurality of casings are supported at one of wall surfaces of the liquid ejection recording apparatus along the top-to-bottom direction.

12. A liquid supply apparatus that is capable of supplying a liquid to a recording head of a liquid ejection recording apparatus, comprising:

a liquid container including a liquid container part that is capable of storing the liquid, and a liquid supply part that is in liquid communication with the inside of the liquid container part and that is capable of supplying the liquid to the recording head of the liquid ejection recording apparatus; and a plurality of casings that each detachably houses therein the liquid container and that is supported by the liquid ejection recording apparatus, wherein the plurality of casings are arranged along a top-to-bottom direction on one of wall surfaces of the liquid ejection recording apparatus, and at least one of the plurality of casings is supported by a paper feed cassette of the liquid ejection recording apparatus, the paper feed cassette being detachably attached to a main body of the liquid ejection recording apparatus.

13. A liquid supply apparatus that is capable of supplying a liquid to a recording head of a liquid ejection recording apparatus, comprising:

a liquid container including a liquid container part that is capable of storing the liquid, and a liquid supply part that is in liquid communication with the inside of the liquid container part and that is capable of supplying the liquid to the recording head of the liquid ejection recording apparatus; and a plurality of casings that each detachably houses therein the liquid container and that is supported by the liquid ejection recording apparatus, wherein the plurality of casings are arranged along a top-to-bottom direction on one of wall surfaces of the liquid ejection recording apparatus, the liquid container further includes a container-side electrical connection part, and each of the plurality of casings further includes an apparatus-side electrical connection part that is capable of establishing electrical connection by contacting with the container-side electrical connection part, and an electric wire electrically connected to the apparatus-side electrical connection part and to the liquid election recording apparatus.

14. The liquid supply apparatus according to claim 13, wherein each of the plurality of casings includes a liquid introduction part that is connectable to the liquid supply part, and a flow passage member that is flexible and is connected to the liquid introduction part, the flow passage member supplying the liquid from the liquid introduction part to the recording head of the liquid ejection recording apparatus.

15. The liquid supply apparatus according to claim 13, wherein each of the plurality of casings further includes a member relay part on at least one end portion thereof in the top-to-bottom direction, the member relay part guiding the flow passage member to the outside of the corresponding casing.

16. The liquid supply apparatus according to claim 13, wherein each of the plurality of casings further includes a wire relay part on at least one end portion thereof in the top-to-bottom direction, the wire relay part guiding the electric wire to the liquid ejection apparatus.

* * * * *